US006148159A

United States Patent [19]

Shiraishi

[11] Patent Number: 6,148,159

[45] Date of Patent: Nov. 14, 2000

[54] ELECTROPHOTOGRAPHIC PRINTER

[75] Inventor: Toyokazu Shiraishi, Tokyo, Japan

[73] Assignee: Oki Data Corporation, Tokyo, Japan

[21] Appl. No.: 09/329,424

[22] Filed: Jun. 10, 1999

[30] Foreign Application Priority Data

Jun. 12, 1998 [JP] Japan ..... 10-165456
Feb. 10, 1999 [JP] Japan ..... 11-033014

[51] Int. Cl.[7] ..... G03G 15/01

[52] U.S. Cl. ..... 399/44; 399/66; 399/299; 399/306

[58] Field of Search ..... 399/44, 66, 299, 399/303, 317, 300, 306, 223, 331, 313, 312, 324; 347/115

[56] References Cited

U.S. PATENT DOCUMENTS 5,740,493 4/1998 Otaki et al. ..... 399/71
5,893,017 4/1999 Yamamoto ..... 399/299

*Primary Examiner*—Quana M. Grainger
*Attorney, Agent, or Firm*—Akin, Gump, Strauss, Hauer & Feld, L.L.P.

[57] ABSTRACT

An electrophotographic has a transfer belt, a plurality of image-bearing bodies, and a plurality of transferring devices. The transfer belt is driven to run with a print medium placed thereon. The plurality of image-bearing bodies are disposed in a direction in which the transfer belt runs. Each of the plurality of transferring devices opposes a corresponding one of the plurality of image bearing bodies to form a transfer section. Each of the transferring devices selectively receives a first voltage (i.e., transfer voltage Va) and a second voltage (i.e., non-transfer voltage Vb) same as or lower than the first voltage. The first voltage is received when an image of a corresponding color is being transferred from a corresponding one of the image bearing bodies to the print medium. The second voltage is received when the image of the corresponding color is not being transferred from the corresponding one of the image bearing bodies to the print medium.

17 Claims, 30 Drawing Sheets

FIG.15
TABLE I

LOW TEMPERATURE & HIGH HUMIDITY ENVIRONMENT

HIGH TEMPERATURE & HIGH HUMIDITY ENVIRONMENT

| ENVIRONMENT | 8 | 7 | 6 | 5 | 4 | 3 | 2 | 1 |
|---|---|---|---|---|---|---|---|---|
| CORRECTION VOLTAGE | 0 [V] | 0 [V] | 0 [V] | 0 [V] | +100 [V] | +200 [V] | +300 [V] | +400 [V] |

FIG.16A

TABLE II

ENTRY:ENVIRONMENTS

| | | HUMIDITY [%] | | | | | | | | |
|---|---|---|---|---|---|---|---|---|---|---|
| | SENSOR READING | <15 | 15~24.9 | 25~34.9 | 35~44.9 | 45~54.9 | 55~64.9 | 65~74.9 | 75~84.9 | 85≦ |
| TEMPERATURE [°C] | <5 | 8 | 7 | 6 | 6 | 6 | 5 | 5 | 5 | 5 |
| | 5~ 9.9 | 7 | 7 | 6 | 6 | 5 | 5 | 5 | 5 | 5 |
| | 10~14.9 | 7 | 6 | 6 | 5 | 5 | 5 | 5 | 4 | 4 |
| | 15~19.9 | 6 | 6 | 5 | 5 | 5 | 4 | 4 | 4 | 3 |
| | 20~24.9 | 6 | 5 | 5 | 4 | 4 | 4 | 3 | 3 | 3 |
| | 25~29.9 | 6 | 5 | 5 | 4 | 3 | 3 | 3 | 2 | 2 |
| | 30~34.9 | 6 | 5 | 4 | 4 | 3 | 3 | 2 | 2 | 1 |
| | 35~39.9 | 5 | 5 | 4 | 3 | 3 | 2 | 2 | 1 | 1 |
| | 40≦ | 5 | 4 | 4 | 3 | 2 | 2 | 1 | 1 | 1 |

FIG.16B

TABLE III

| ENVIRONMENT | 1 | 2 | 3 | 4 | 5 | 6 | 7 | 8 |
|---|---|---|---|---|---|---|---|---|
| CORRECTION VOLTAGE LEVEL | 4 | 3 | 2 | 1 | 0 | 0 | 0 | 0 |

FIG.25B

TABLE Ⅳ

| NUMBER OF PAGES | 1 | 2 | 3 | 4 | 5< |
|---|---|---|---|---|---|
| INCREMENT OF CORRECTION VOLTAGE LEVEL | INITIAL LEVEL | +1 | +2 | +3 | +3 |

MAX. LEVEL OF CORRECTION VOLTAGE IS 4

FIG.25C

TABLE Ⅴ

| INTERRUPTION | $\tau$ | $2\tau$ | $3\tau$ < |
|---|---|---|---|
| DECREMENT OF CORRECTION VOLTAGE LEVEL | -1 | -2 | INITIAL LEVEL |

$\tau = 10$(S)

FIG.25D

TABLE VI

| CORRECTION VOLTAGE LEVEL | | 0 | 1 | 2 | 3 | 4 |
|---|---|---|---|---|---|---|
| CORRECTION VOLTAGE (VOLTS) | MEDIUM #1 | ±0 | +50 | +150 | +250 | +350 |
| | MEDIUM #2 | ±0 | +100 | +200 | +300 | +400 |
| | MEDIUM #3 | ±0 | +150 | +250 | +350 | +450 |

CORRECTION VOLTAGE FOR MEDIUM #2 IS ALSO SHOWN IN FIG.15

FIG.25E

TABLE VII (FOR ORDINARY PAPER)

| ENVIRONMENT | | 1 | 2 | 3 | 4 | 5 | 6 | 7 | 8 |
|---|---|---|---|---|---|---|---|---|---|
| TRANSFER VOLTAGE Va (kV) | Y,M | 1.7 | 1.8 | 1.9 | 2 | 2.1 | 2.2 | 2.3 | 2.4 |
| | C,K | 1.8 | 1.9 | 1.9 | 2 | 2.1 | 2.2 | 2.3 | 2.4 |
| NON-TRANSFER VOLTAGE Vb (kV) | | 1.7 | 1.8 | 1.9 | 2 | 1 | 0 | 0 | 0 |

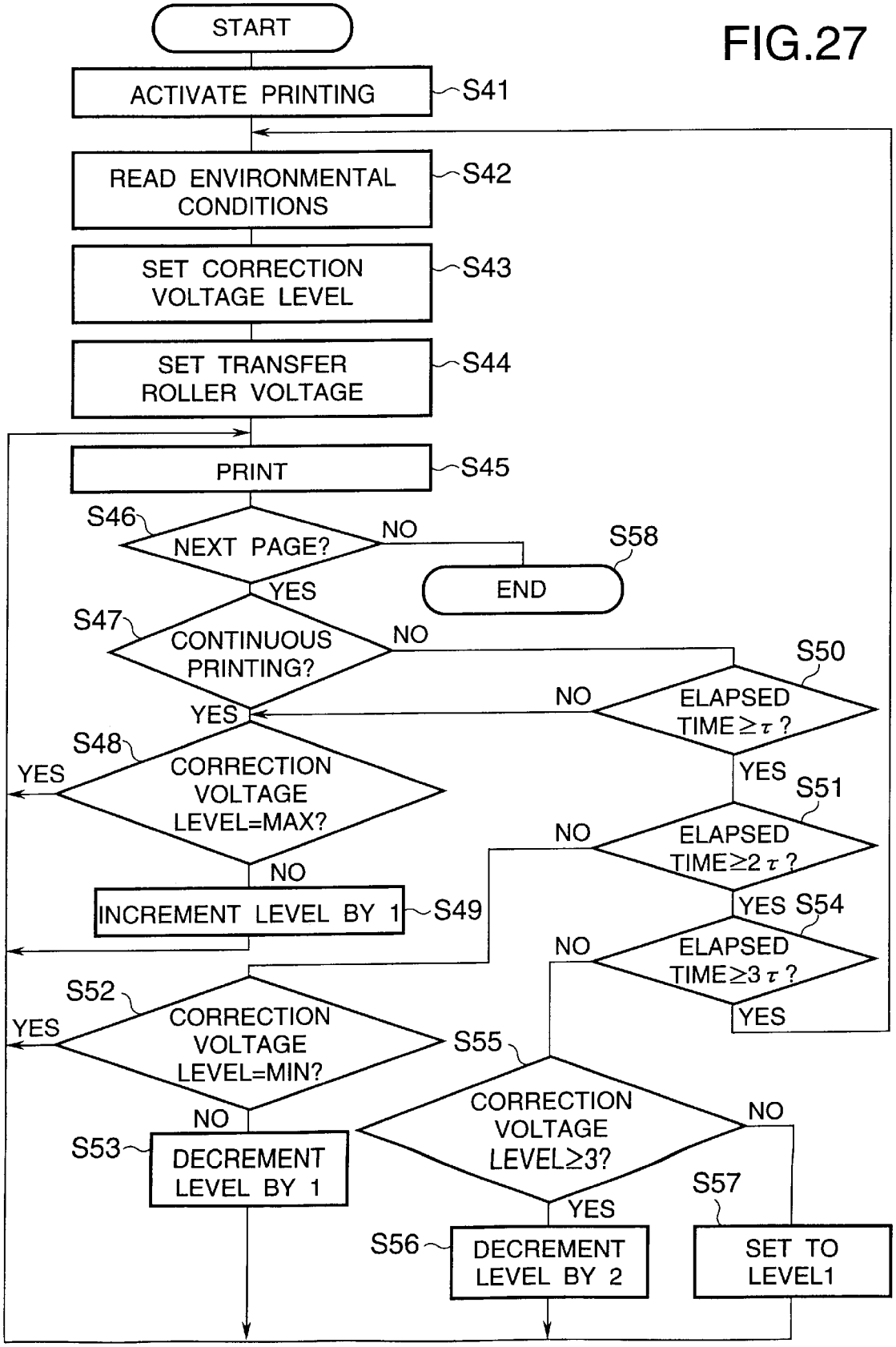
FIG.27
START
ACTIVATE PRINTING
S41
READ ENVIRONMENTAL CONDITIONS
S42
SET CORRECTION VOLTAGE LEVEL
S43
SET TRANSFER ROLLER VOLTAGE
S44
PRINT
S45
S46
NEXT PAGE?
NO
S58
END
YES
S47
CONTINUOUS PRINTING?
NO
S50
ELAPSED TIME≥τ ?
NO
YES
S48
CORRECTION VOLTAGE LEVEL=MAX?
YES
YES
S51
ELAPSED TIME≥2τ ?
NO
NO
INCREMENT LEVEL BY 1
S49
YES S54
ELAPSED TIME≥3τ ?
NO
YES
S52
CORRECTION VOLTAGE LEVEL=MIN?
YES
S55
CORRECTION VOLTAGE LEVEL≥3?
NO
NO
S53
DECREMENT LEVEL BY 1
YES
S57
S56
DECREMENT LEVEL BY 2
SET TO LEVEL1

ELECTROPHOTOGRAPHIC PRINTER

FIELD OF THE INVENTION

The present invention relates to an electrophotographic printer.

DESCRIPTION OF THE RELATED ART

A conventional electrophotographic printer performs the steps of charging, exposing, developing, transferring, and fixing. Upon a print instruction, a print medium is fed manually or automatically by a feeding roller. The print medium is electrostatically attracted to a transfer belt which in turn transports the print medium to a transfer section defined between a photoconductive drum and a transfer roller.

For color printing, a plurality of photoconductive drums for yellow, magenta, cyan, and black images are aligned along the transfer belt. The photoconductive drums are mounted so that they can be moved between an operative position where the photoconductive drum is moved into contact engagement with the belt and a non-operative position where the photoconductive drum is moved out of contact engagement with the belt. The transfer belt is sandwiched between the photoconductive drums. When the transfer belt runs between the photoconductive drums and the transfer rollers with the print medium are attracted thereto, toner images of the respective colors on the photoconductive drums are transferred from the photoconductive drum.

The respective photoconductive drums may be individually moved between the operative position and non-operative position. Thus, the photoconductive drums may be brought into contact engagement with the transfer belt, ensuring long lifetime of the printer. When performing color printing, the photoconductive drums for yellow, magenta, cyan, and black images are moved to their operative positions. When performing black printing, the photoconductive drums for yellow magenta, and cyan images are moved to their non-operative positions and the photoconductive drum for black image is moved to the operative position. After completion of transferring the toner images, the print medium is separated from the transfer belt and advanced to a fixing unit which in turn fixes the toner images on the print medium.

A disadvantage with the aforementioned conventional electrophotographic printer is that since the transfer voltage is the same regardless of whether a print medium is at the transfer section, if a printing operation is performed in a low temperature and low humidity environment, the transfer belt is charged and excessive charging causes malfunction of the controller and paper jamming.

FIG. 35 is a model representation of a relevant portion of a conventional electrophotographic printer. If continuous printing is performed in a low temperature and low humidity environment, the transfer belt is charged with the result being that the print medium is lifted up by the Coulomb force. As a result, when the print medium 19 reaches the transfer point P, the forward end of the print medium 19 is caught by the photoconductive drum 11 or a chassis which in turn causes the print paper to fold over or to be jammed.

Moreover, the lifted print medium 19 is rubbed by the chassis so that the toner images on the printed medium are damaged.

SUMMARY OF THE INVENTION

The present invention was made in view of the aforementioned drawbacks.

An object of the invention is to provide an electrophotographic printer in which no malfunction of a controller and paper jamming occur, and print quality is prevented from deteriorating.

An electrophotographic printer has a transfer belt, a plurality of image-bearing bodies, and a plurality of transferring devices. The transfer belt is driven to run with a print medium placed thereon. The plurality of image-bearing bodies are disposed in a direction in which the transfer belt runs. Each of the plurality of transferring devices opposes a corresponding one of the plurality of image bearing bodies to form a transfer section. Each of the transferring devices selectively receives a first voltage (i.e., transfer voltage Va) and a second voltage (i.e., non-transfer voltage Vb) supplied thereto. The first voltage is received when an image of a corresponding color is being transferred from a corresponding one of the image bearing bodies to the print medium. The second voltage is received when the image of the corresponding color is not being transferred from the corresponding one of the image bearing bodies to the print medium.

The electrophotographic printer further includes a transfer voltage outputting section, an environmental condition detector, and a transfer voltage setting section. The environmental condition detector selectively applies the first voltage and the second voltage to each of the transferring devices. The first voltage is higher than the second voltage. The environmental condition detector detects environmental conditions and the transfer voltage setting section that sets the second voltage in accordance with the environmental conditions.

The second voltage may be set lower in a low-temperature and low-humidity environment than in a high-temperature and high-humidity environment.

The electrophotographic printer may further include a print-medium sensor and a transfer voltage correcting section. The print-medium sensor detects a position of the print medium relative to the transfer section. The transfer voltage correcting section adjusts the first voltage applied to one of the plurality of transferring devices when a rearward end of the print medium leaves another one of the plurality of the transferring devices.

The electrophotographic printer may still further include a counter that detects a number of cumulative rotations of each of the plurality of image-bearing bodies. One of the plurality of image-bearing bodies is moved to the operative position in accordance with the number of cumulative rotations.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 15 illustrates Table I illustrating environmental conditions and corresponding corrected voltages in a second embodiment;

FIG. 16A illustrates Table II that lists environments and corresponding temperature ranges and humidity ranges;

FIG. 16B illustrates Table II that lists environments and corresponding correction voltage levels;

FIGS. 25B–25E shows Tables IV to VII which list various settings of correction voltage levels, correction voltages, and transfer voltages according to kinds of print medium and environmental conditions;

FIG. 27 is a flowchart illustrating the operation of the electrophotographic printer according to the third embodiment;

DESCRIPTION OF THE INVENTION

Figure 1:
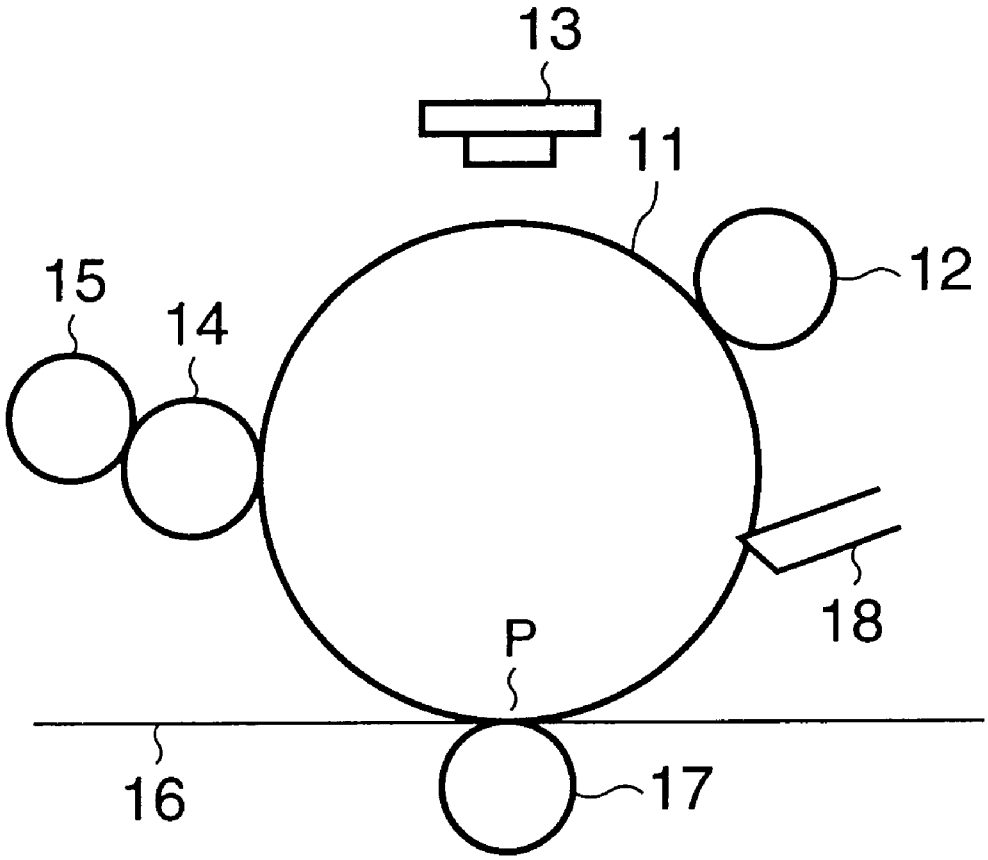
FIG. 1 is a general construction of an image-forming section of an electrophotographic printer according to a first embodiment.

Preferred embodiments of the present invention will be described in detail with reference to the accompanying drawings. Elements of the same construction have been given the same reference numerals throughout the embodiments and the description thereof is omitted.

First Embodiment

In this specification, the term "continuous printing" is used to cover a printing operation in which a following one of consecutive printings is performed after the preceding one without the driving mechanism of the printer interrupted. The term "intermittent printing" is used to cover a printing operation in which the driving mechanism comes to a stop after a preceding one of consecutive printings has been performed and then the driving mechanism is again activated when a following one is performed. The driving mechanism comes to a stop, for example, after the completion of a job or in the middle of a job due to jam, run-out-of-toner, and open-cover.

Construction

FIG. 1 illustrates a general construction of an image-forming section of an electrophotographic printer according to a first embodiment.

Referring to FIG. 1, a charging roller 12 charges a surface of a photoconductive drum 11. An exposing unit 13 illuminates the charged surface of the photoconductive drum 11 to form an electrostatic latent image, not shown. A developing roller 14 develops the electrostatic latent image into a toner image. The developing roller 14 is supplied with toner from a toner supplying roller 15. The toner supplying roller 15 and developing roller 14 form a developing unit.

A transfer belt 16 is driven by a drive source, not shown, to run, with a print medium, not shown, attracting thereon. A transfer roller 17 cooperates with the photoconductive drum 11 to define the transfer point P between the photoconductive drum 11 and the transfer roller 17. A cleaning blade 18 removes residual toner particles on the photoconductive drum 11.

Figure 2:
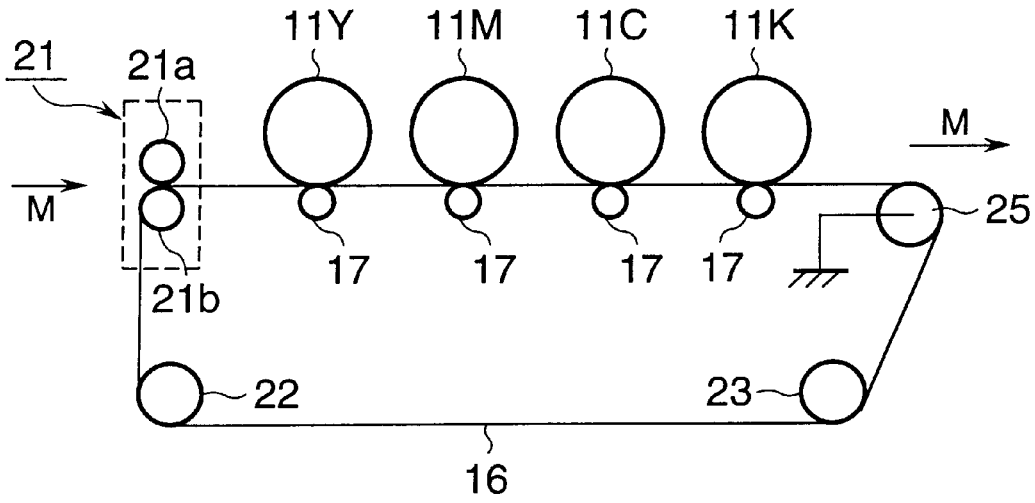
FIG. 2 illustrates the electrophotographic printer according to the first embodiment when color printing is performed.
Figure 3:
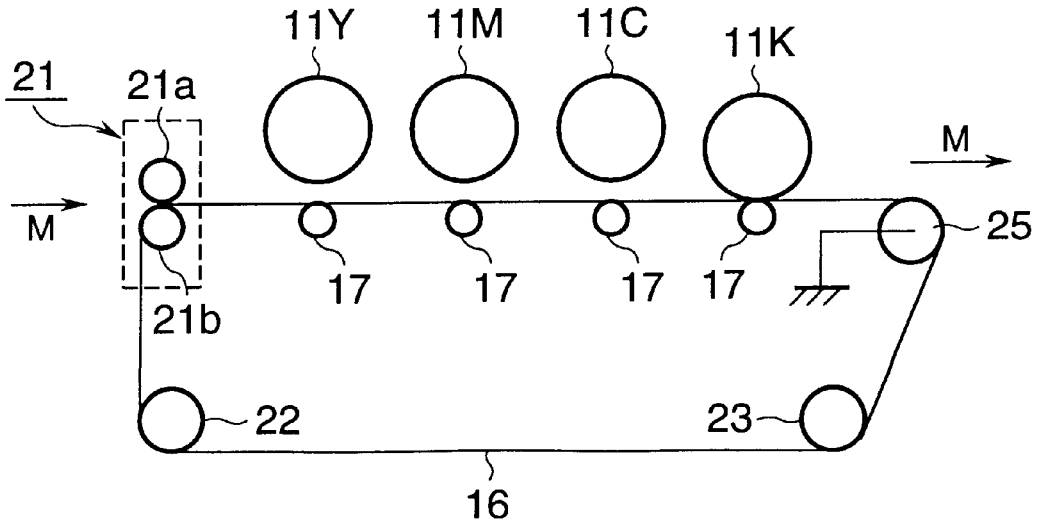
FIG. 3 illustrates the electrophotographic printer according to the first embodiment when black printing is performed.

FIG. 2 illustrates the electrophotographic printer according to the first embodiment when color printing is performed. FIG. 3 illustrates the electrophotographic printer according to the first embodiment when black printing is performed.

Referring to FIGS. 2 and 3, the photoconductive drums 11Y, 11M, 11C, and 11K oppose the corresponding transfer rollers 17 with the transfer belt 16 sandwiched between the photoconductive drums and the corresponding transfer rollers. The print medium travels in a direction shown by arrows M.

When color printing is performed, the photoconductive drums 11Y, 11M, 11C, and 11K are brought to their operative positions, i.e., the photoconductive drums come into contact with the transfer belt 16.

An attraction section 21 includes a first attraction roller 21*a* and a second attraction roller 21*b*, and causes the transfer belt 16 to attract the print medium fed in a direction of arrow from a paper cassette, not shown. The transfer belt 16 is mounted about a drive roller 25, a first attraction roller 21*a*, the second attraction roller 21*b*, and idle rollers 22 and 23. The transfer belt 16 is driven in rotation by a drive source, not shown. When images of all colors have been transferred to the print medium, the drive roller 25 is grounded to separate the print medium from the transfer belt 16. The separated print medium is then advanced in the direction of arrow M to a fixing unit, not shown.

When black printing is performed, the photoconductive drums 11Y, 11M, and 11C for yellow, magenta, and cyan, respectively, are moved to their non-operative positions where the drums are not in contact with the transfer belt 16, and the photoconductive drum 11K for black is brought to its operative position.

Figure 4:
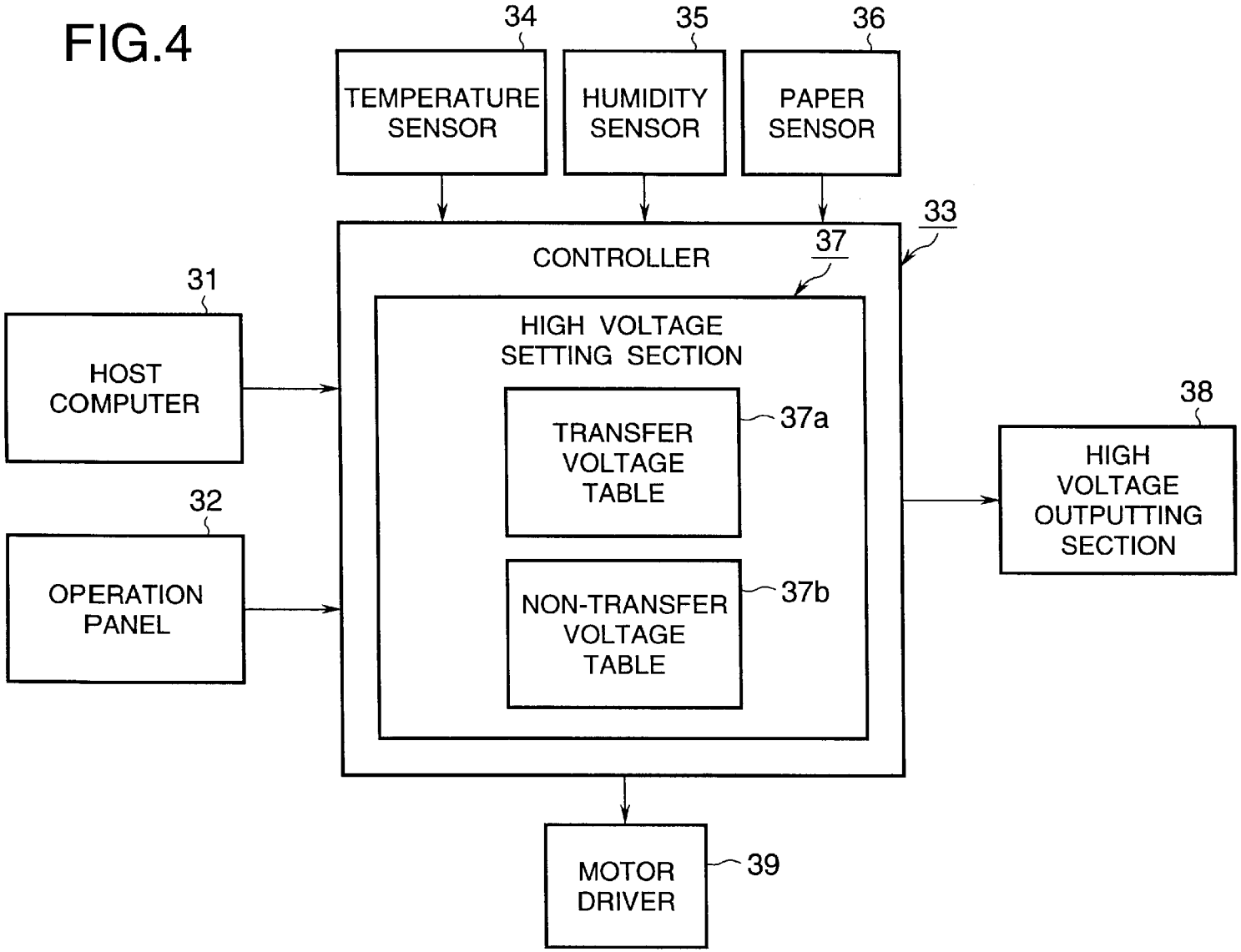
FIG. 4 is a block diagram illustrating the electrophotographic printer according to the first embodiment.

FIG. 4 is a block diagram illustrating an electrophotographic printer according to the first embodiment. Referring to FIG. 4, a controller 33 receives print data and various settings from a host computer 31, and controls the overall operation of the electrophotographic printer. The controller 33 also receives instructions and commands through an operation panel 32 from a user and sets print conditions on the basis of the received settings. A temperature sensor 34 detects the temperature of an environment in which the printer is placed, and sends a detection signal to the controller 33. A humidity sensor 35 detects the humidity of an environment in which the printer is placed, and sends a detection signal to the controller 33. Paper sensors 36 detect the size, current position, and transport condition of a print medium being transported, and sends detection signals to the controller 33. The temperature sensor 34 and humidity sensor 35 form an environmental condition detector.

A high voltage setting section 37 resides in the controller 33 and sets a value of transfer roller voltage on the basis of the detection signals of the temperature sensor 34 and the humidity sensor 35. The high voltage setting section 37 includes a transfer voltage table 37*a* that lists transfer voltages Va, and a non-transfer voltage table 37*b* that lists non-transfer voltage Vb.

The high voltage setting section 37 sets the transfer roller voltage, which is either the transfer voltage Va or non-transfer voltage Vb, depending on situations. A high voltage outputting section 38 outputs the transfer roller voltage at predetermined timings. A motor driver 39 generates timing signals that drive a drive source, not shown.

Transfer Roller Voltage

Figure 5:
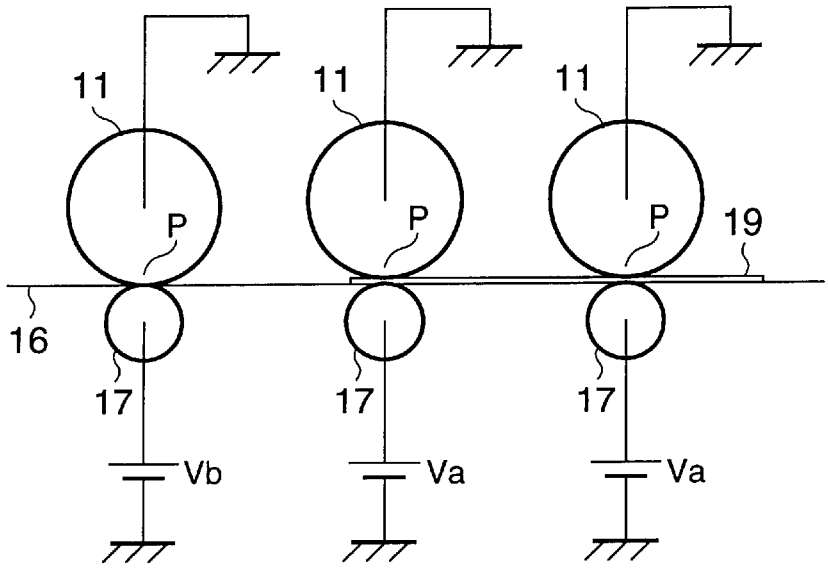
FIG. 5 illustrates the relationship between the position of print medium and transfer roller voltage in the first embodiment.

FIG. 5 illustrates the relationship between the position of print medium and transfer roller voltage in the first embodiment. Referring to FIG. 5, when the print medium 19 is present at the transfer point P, the transfer voltage Va is applied to the transfer roller 17. When the print medium 19 is not at the transfer point P, the non-transfer voltage Vb is applied to the transfer roller 17.

Figure 6:
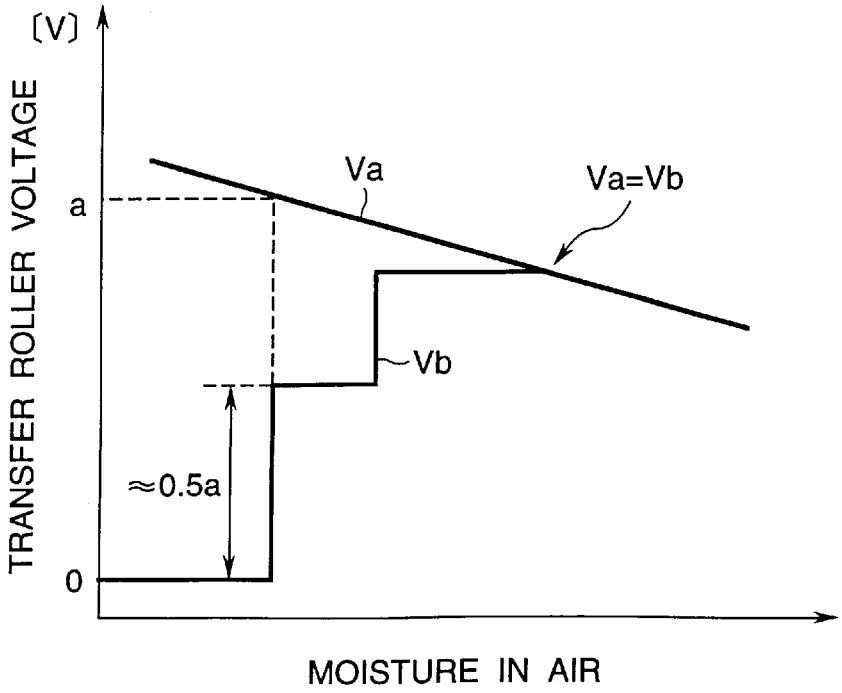
FIG. 6 illustrates the relationship between the transfer roller voltage and moisture content in air.

FIG. 6 illustrates the relationship between the transfer roller voltage (Va and Vb) and moisture content in air. FIG. 6 plots moisture in the air as the abscissa and transfer roller voltage as the ordinate.

Referring to FIG. 6, straight line shows the transfer voltage Va and stepped line shows non-transfer voltage Vb. The value of the non-transfer voltage Vb is no more than the transfer voltage Va.

According to FIG. 6, the transfer roller voltage may be varied in accordance with the moisture contained in air, thereby applying an optimum transfer roller voltage to the transfer roller 17 in accordance with environmental condition. The high voltage setting section 37 causes the non-transfer voltage Vb to change stepwise in accordance with detection signals of the temperature sensor 34 and humidity sensor 35. If the moisture content in the air is relatively low and therefore the detection signals decrease below thresholds, the non-transfer voltage Vb is decreased or set to zero volts. If the moisture content in the air is relatively high and therefore the detection signals increase above the thresholds, the non-transfer voltage Vb is set to the same value as the transfer voltage Va or to a value not higher than the transfer voltage Va.

If the detection signals are about medium values, the non-transfer voltage Vb is set to a value of about 50% of the transfer voltage Va. The non-transfer voltage Vb may be decreased when the detection signals are below first thresholds, and set to zero volts when the detection signals are below second thresholds.

Lowering the transfer voltage minimizes the charging of the transfer belt 16 when continuous printing is performed in a low-temperature and low-humidity environment. As a result, the controller 33 is prevented from malfunctioning.

As described above, the transfer belt 16 is less charged. The print medium 19 is prevented from being lifted from the transfer belt 16 by the Coulomb force, or the forward end of the print medium 19 is not caught by the chassis or the photoconductive drum 11 when the print medium travels. Thus, paper jamming is prevented.

Since the print medium 19 is not lifted from the transfer belt 16 by the Coulomb force, the surface of the print medium 19 on which toner images are transferred is not rubbed by the chassis.

Operation

The operation of the electrophotographic printer of the aforementioned construction will now be described.

Figure 7:
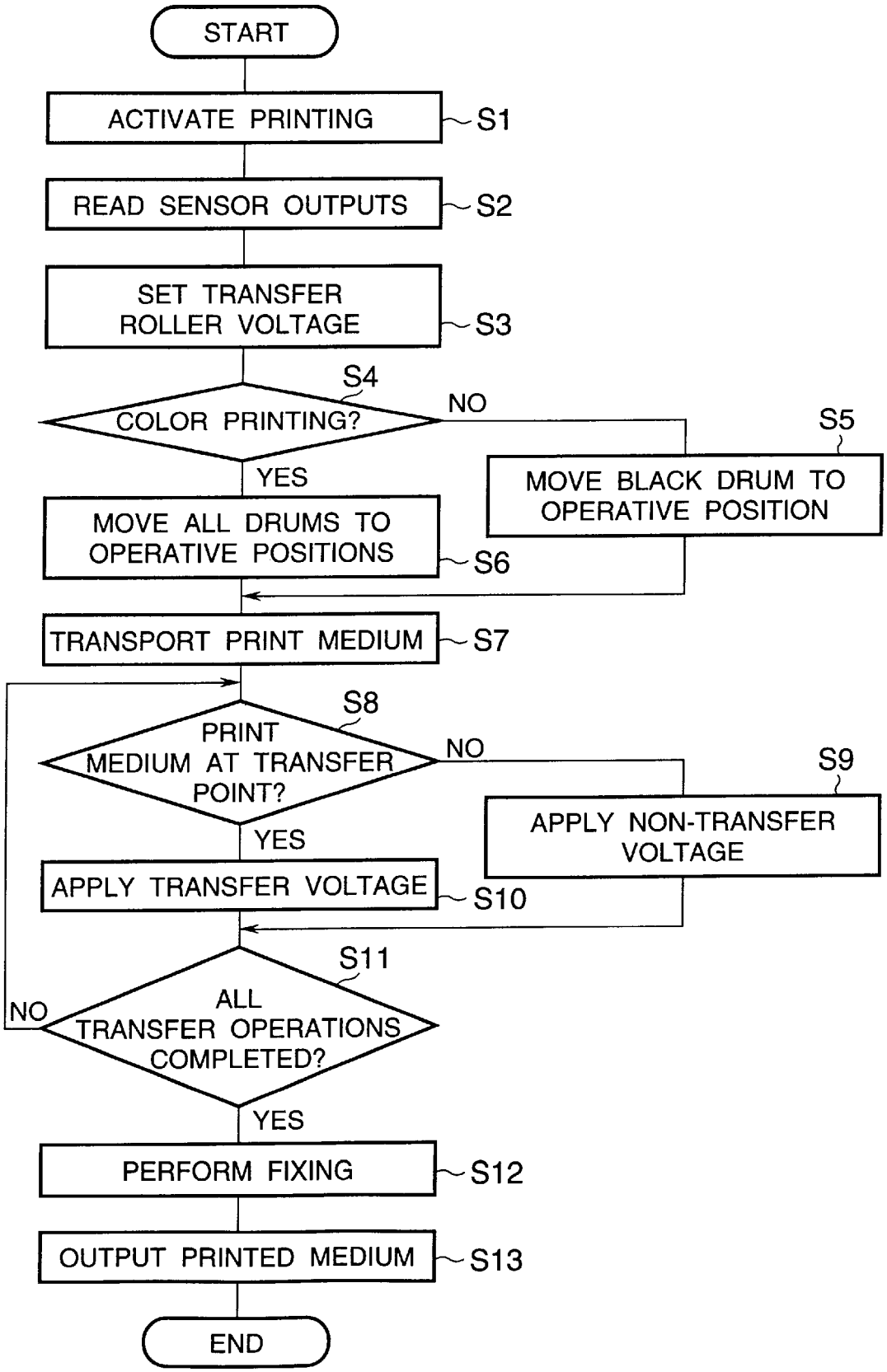
FIG. 7 is a flowchart showing the operation of the electrophotographic printer according to the first embodiment.

FIG. 7 is a flowchart showing the operation of the electrophotographic printer according to the first embodiment.

When the controller 33 (FIG. 4) receives print data from the host computer 31 and a printing is activated at step S1, the high voltage setting section 37 reads the detection signals from the temperature sensor 34 and humidity sensor 35 at Step S2. Then, the controller 33 checks environmental conditions on the basis of the detection signals outputted from the sensors, thereby setting at step S3 the transfer roller voltages $Tr_Y$, $Tr_M$, $Tr_C$ and $Tr_K$ for the respective transfer sections according to the environmental conditions. Then, the controller 33 checks the print data at step S4 to determine whether the print data is for color printing or black printing. If the print data is for color printing, the photoconductive drums 11Y, 11M, 11C, and 11K are all moved to their operative positions at step S6. If the print data is for black printing, the photoconductive drums 11Y, 11M, and 11C are moved to their non-operative positions and the photoconductive drum 11K to its operative position at step S5.

Figure 8:
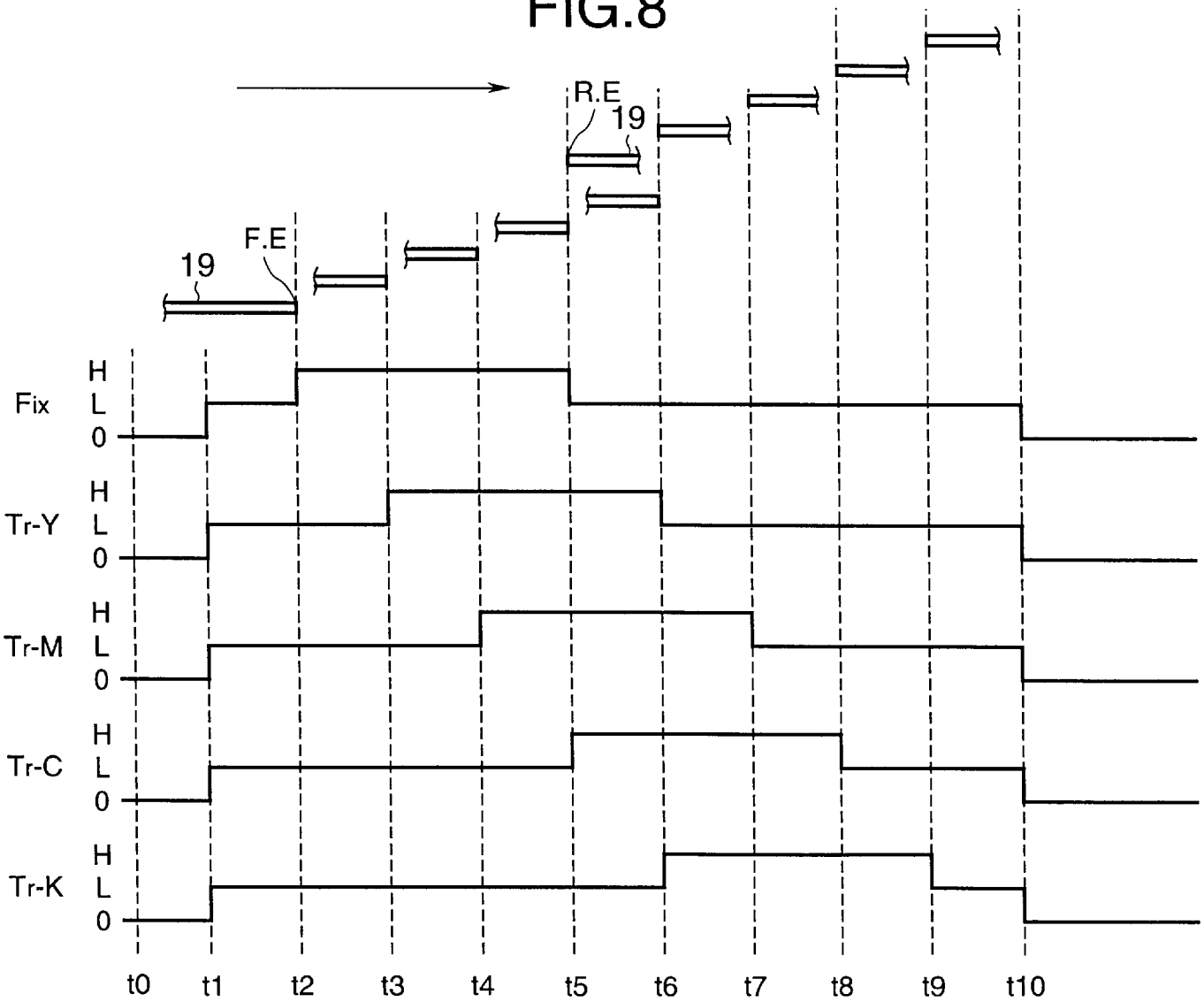
FIG. 8 is a timing chart illustrating the operation of the high voltage setting section.

At step S7, the controller 133 causes the transfer belt 16 to attract the print medium 19 thereto and transport the print medium 19 (FIG. 5) through transfer sections for corresponding colors. A check is made at step S8 to determine whether the print medium 19 is at a transfer point P between the transfer belt 16 and any one of the photoconductive drums 11Y, 11M, 11C, and 11K. If the print medium 19 is at the transfer point P, the program proceeds to step S10 where the corresponding one of the transfer roller voltages $Tr_Y$, $Tr_M$, $Tr_C$, and $Tr_K$ is set to a high level (Va) at step 10 and applied to the transfer rollers 17 (FIG. 8). The transfer roller voltages $Tr_Y$, $Tr_M$, $Tr_C$, and $Tr_K$ are set and applied in order.

The transfer voltage is set to the high level (Va) during a period from the time when the forward end of the print medium 19 arrives at the corresponding transfer point P till the beginning of the print region on the print medium 19 reaches the transfer point P.

If the print medium 19 is at the transfer point P, the program proceeds to step S9 where the corresponding one of the transfer roller voltages $Tr_Y$, $Tr_M$, $Tr_C$, and $Tr_K$ is set to a low level (Vb) before the forward end of the print medium 19 arrives at the transfer points P. The transfer roller voltages $Tr_Y$, $Tr_M$, $Tr_C$, and $Tr_K$ also remain set to the low level (Vb) during a period from when the rearward end of the print region on the print medium 19 arrives at the corresponding transfer point P till the rearward end of the print medium has passed the transfer point P.

When the print medium 19 is absent from a transfer point P, the corresponding one of transfer roller voltages $Tr_Y$, $Tr_M$, $Tr_C$, and $Tr_K$ is not set to a high level (Va), preventing a large transfer current from flowing through the transfer points. This prevents the transfer belt 16 and photoconductive drums 11Y, 11M, 11C, and 11K from deteriorating, thereby maintaining the print quality.

If the detection signals outputted from the temperature sensor 34 and humidity sensor 35 indicate that the transfer belt 16 and the print medium 19 are in a low temperature and low humidity environment where the transfer belt 16 and the print medium 19 are apt to be charged, the non-transfer voltage Vb is set to about 50% of the transfer voltage Va or to zero volts.

The impedances of the print medium 19 and transfer belt 16 become high in a low temperature and low humidity environment. Therefore, when the non-transfer voltage Vb is set to about 50% of the transfer voltage Va or to zero volts, no significant leakage current will flow from the attraction section 21 or transfer point(s) P to which the voltage Va is applied, to a transfer point to which the voltage Vb is applied.

A check is made at step S11 to determine whether transfer operations at all the transfer points P have completed. If YES at step S11, the program proceeds to step S12 where the print medium 19 leaves the transfer belt 16 and advances to a fixing unit, not shown, where the toner image on the print medium is then fixed. If NO at step S11, the program loops back to step S8. The print result is output at step S13.

FIG. 8 is a timing chart illustrating the operation of the high voltage setting section 37. When a printing is activated at time t0, the high voltage setting section 37 sets an attraction voltage $F_{ix}$ to a low level L at time t1 and transfer roller voltages $Tr_Y$, $Tr_M$, $Tr_C$, and $Tr_K$ to low levels, i.e., non-transfer voltage Vb (FIG. 6), the transfer roller voltages $Tr_Y$, $Tr_M$, $Tr_C$, and $Tr_K$ being voltages applied to transfer rollers 17 for yellow, magenta, cyan, and black images. The attraction voltage $F_{ix}$ is set to a high level at time t2 at which the forward end (F.E) of print medium arrives at the attraction section 21. Then, the attraction voltage $F_{ix}$ is then set to the low level at time t5 at which the rearward end (R.E) of the print medium leaves the attraction section 21. The attraction voltage $F_{ix}$ is finally set to zero at time t10.

The transfer voltages $Tr_Y$, $Tr_M$, $Tr_C$, and $Tr_K$ are set to a high level (Va) at times t3, t4, t5, and t6, respectively. Times t3, t4, t5, and t6 are timings at which the forward end of the print medium 19 arrives at the transfer point P for yellow, magenta, cyan, and black images, respectively.

Then, the transfer voltages $Tr_Y$, $Tr_M$, $Tr_C$, and $Tr_K$ are set to a low level (Vb) at times t6, t7, t8, and t9, respectively. Times t6, t7, t8, and t9 are timings at which the rearward end of the print medium 19 leaves the transfer points P for yellow, magenta, cyan, and black images, respectively.

At time t10, the transfer voltages $Tr_Y$, $Tr_M$, $Tr_C$, $Tr_K$, and $Tr_M$ are set to zero volts.

At time t5, the attraction voltage $F_{ix}$ is set to a low level and the transfer voltage $Tr_C$ to a high level for the sake of explanation. The attraction voltage $F_{ix}$ and the transfer voltage $Tr_C$ are actually set to the low level and to the high level, respectively, at different timings. For example, when a printing is to be performed on an A4 size paper, the transfer voltage $Tr_C$=Va is first applied to the transfer roller 17 and then the attraction voltage $F_{ix}$ is set to a low level.

As described above, when a continuous printing is performed in a low temperature and low humidity environment, the transfer roller voltage is set to the non-transfer voltage Vb, thereby minimizing the charging of the transfer belt 16. Switching the transfer roller voltage in this manner effectively prevents malfunction of the controller 33 and jamming of print medium.

A check may be made immediately after the activation of a printing to determine whether the print data is for color printing or black printing.

Effects of Leakage Current in First Embodiment

If the print data is for color printing, the transfer operation is performed in a color print mode. If the print data is for black printing, the transfer operation is performed in a black print mode. When the print medium 19 is placed in a high temperature and high humidity environment, the print medium 19 absorbs the moisture in the air and therefore the impedance of the print medium 19 decreases. As a result, a leakage current flows from a transfer point(s) to which the non-transfer voltage Vb is being applied to a transfer point (s) to which the transfer voltage Va is being applied. Therefore, the leakage current disturbs the potential difference developed between the print medium 19 and the photoconductive drums 11Y, 11M, 11C, and 11K, resulting in an unstable electric field between the print medium 19 and the photoconductive drums. The unstable electric field causes poor transfer results.

Figure 9:
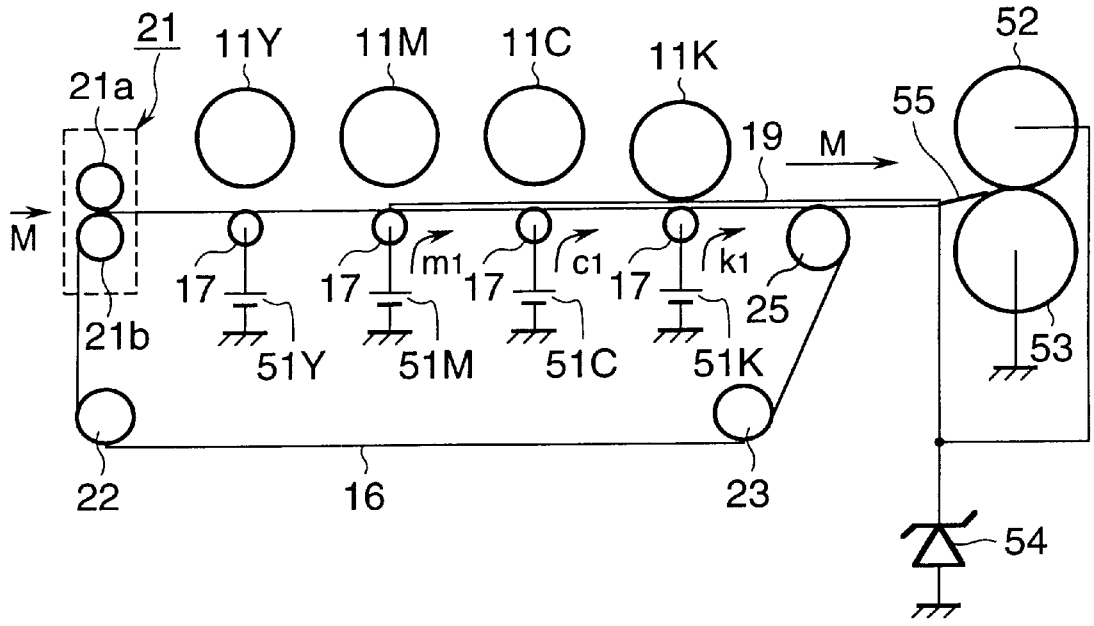
FIG. 9 illustrates leakage current during black printing.

FIG. 9 illustrates leakage current during black printing. Elements of the same construction as those shown in FIG. 3 have been given the same reference numerals and description thereof is omitted. The print medium travels in a direction shown by arrows M.

Referring to FIG. 9, a guide metal plate 55 is placed between the transfer belt 16 and a contact point between a heat roller 52 and a back up roller 53. The guide plate 55 is electrically connected to the shaft of the heat roller 52. A Zener diode 54 is connected between the ground and the guide metal plate 55, thereby neutralizing the print medium 19 through the guide metal plate 55 in a low temperature and low humidity environment. Thus, the print medium 19 is prevented from being charged, eliminating the problem of poor print quality and unstable transport of the print medium 19. The Zener diode 54 clamps the transfer voltage at a predetermined value, thereby preventing leakage current from flowing from the respective transfer sections to the heat roller 52. The photoconductive drums 11Y, 11M, and 11C are moved to their non-operative positions while the photoconductive drum 11K is positioned at its operative position.

Power supplies 51Y, 51M, and 51C apply transfer roller voltages $Tr_Y$, $Tr_M$, and $Tr_C$ to the corresponding transfer rollers 17, all the transfer roller voltages being non-transfer voltage Vb regardless of whether a print medium is present at the corresponding transfer point. A power supply 51K for black applies the transfer roller voltage $Tr_K$=Vb to the transfer roller 17 when the print medium 19 is present at the transfer point P, and the transfer voltage $Tr_K$=Va when the print medium 19 is absent.

When the print medium 19 is placed in a high temperature and high humidity environment, the print medium 19 absorbs the moisture in the air and therefore the impedance of the print medium decreases. As a result, a leakage current flows through the print medium 19 from transfer point(s) to which the non-transfer voltage Vb is being applied to transfer point(s) to which the transfer voltage Va is being applied. For example, as depicted by arrows m1 and c1 in FIG. 9, when the rearward end of the print medium 19 is passing the magenta transfer point P, the leakage current flows from the magenta and cyan transfer points to the black transfer point.

As a result, the potential difference between the photoconductive drum 11K and the print medium 19 becomes high, resulting in an increased electric field.

A portion of the transfer current that flows through the black transfer point flows through the print medium 19 to the heat roller 52 in a direction shown by arrow k1 in FIG. 9. However, as previously described, the metal guide plate 55 is disposed across the black transfer point P and the heat roller 52, so that the transfer point P is clamped at a predetermined voltage. Thus, an amount of current that flows to the heat roller 52 is very small (less than 1 $\mu$A) and therefore does not affect the transfer effect.

The transfer roller voltages $Tr_Y$, $Tr_M$, $Tr_C$, and $Tr_K$ when the leakage current flows will be described.

Figure 10:
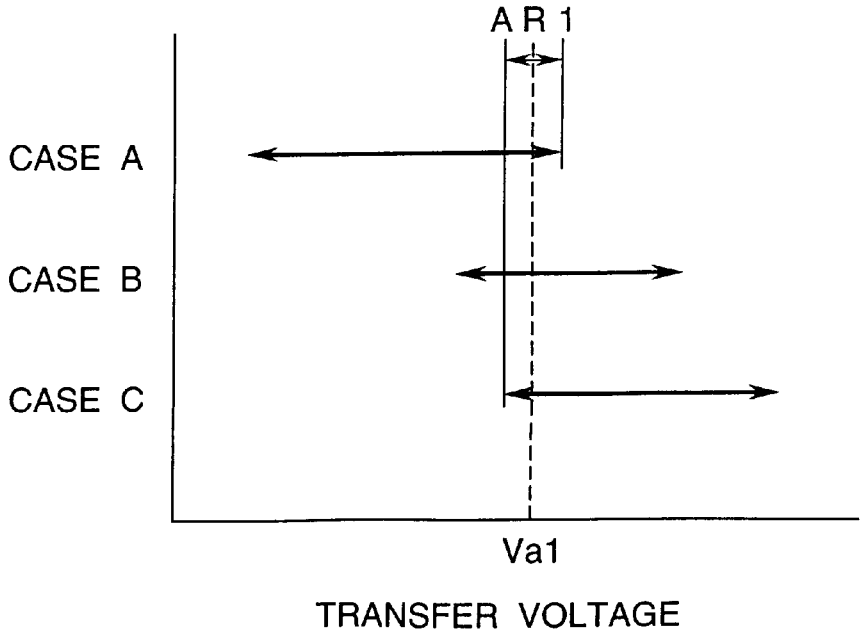
FIGS. 10 and 11 illustrate the transfer roller voltages for three cases.
Figure 11:
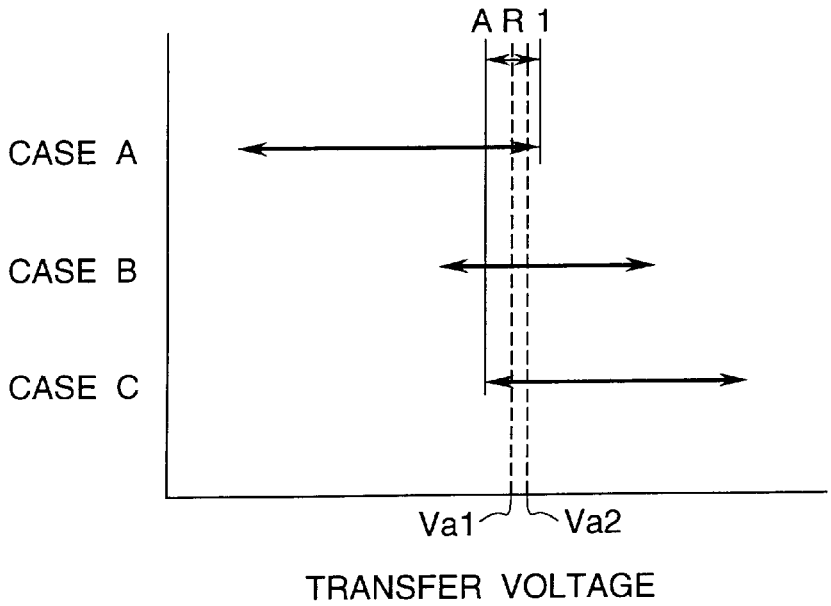

FIGS. 10 and 11 illustrate the transfer roller voltages for three cases.

When the toner images on the photoconductive drums 11Y, 11M, 11C, and 11K are transferred to the print medium 19, the transfer load varies depending on the print duty of an image on one page of print medium 19. Referring to FIG. 10, arrows show ranges of transfer voltage for cases A to C having a print duty in the ranges 70–100%, 30–70%, and 0–30%, respectively. From FIG. 10, the transfer roller voltage Va is set to Va1, i.e., in the middle of the range AR1 where any of cases A–C provides good transfer result.

For example, if a leakage current flows to the black transfer point, the apparent transfer roller voltage $Tr_K$ becomes higher by the leakage current. However, the impedance of the print medium 19 becomes low in an high temperature and high humidity environment, and therefore the apparent transfer roller voltage $Tr_K$ decreases corresponding to the decrease in impedance.

When a leakage current flows from a transfer section(s) where a transfer operation is not being performed to a transfer section for black where a transfer operation is being performed, an apparent transfer roller voltage $Tr_K$ becomes Va2 in the range AR1 as shown in FIG. 11. The voltage Va2 is slightly higher than the previous value Va1. As a result, transfer effect at the transfer section for black is enhanced.

A case will be described in which leakage current does not flow from a transfer section where transfer operation is not being performed to a transfer section where transfer operation is being performed.

Figure 12:
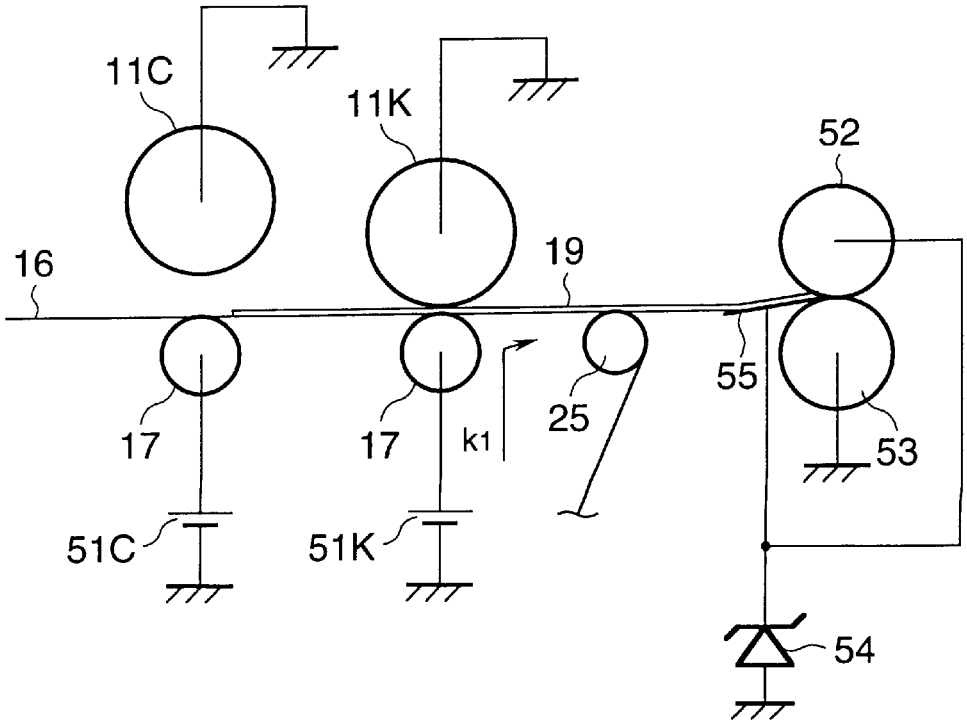
FIG. 12 illustrates the leakage current when black printing is being performed.

FIG. 12 illustrates the leakage current when black printing is being performed.

Figure 13:
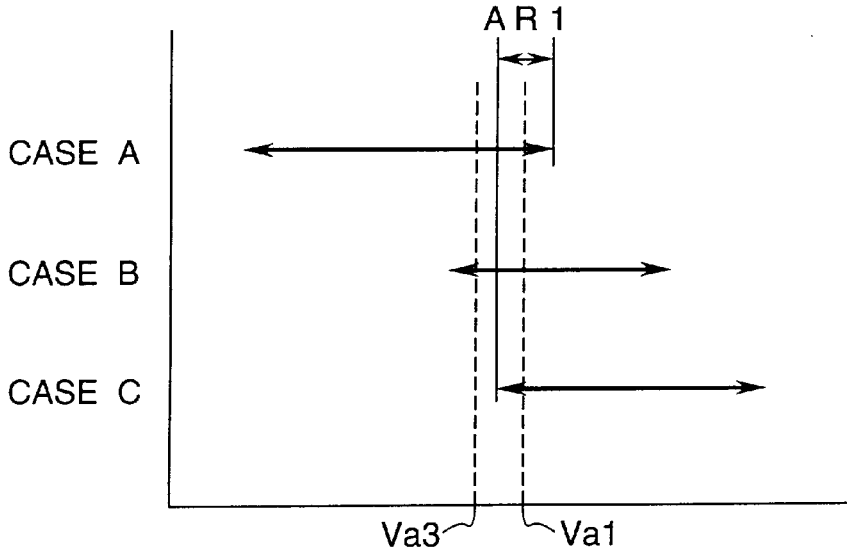
FIG. 13 illustrates the transfer voltage.

FIG. 13 illustrates the transfer voltage.

Elements of the same construction as those of FIG. 9 have been given the same references and description thereof is omitted.

As shown in FIG. 12, when the rearward end of the print medium 19 has left the transfer section for cyan, the leakage current that flows from the transfer section for cyan to the transfer section for black no longer exists. Only a small portion of the transfer current that flows through the black transfer point flows through the print medium 19 to the heat roller 52 in a direction shown by arrow k1. Thus, the apparent transfer roller voltage $Tr_K$ will not increase. The impedance of the print medium 19 decreases in an high temperature and high humidity environment, and therefore the apparent transfer roller voltage $Tr_K$ will decrease from V1a to Va3 corresponding to the decrease in the impedance of print medium, V1a to Va3 being outside of the range AR1. As a result, the transferring effect at the transfer section for black decreases.

Color printing will be described.

Figure 14:
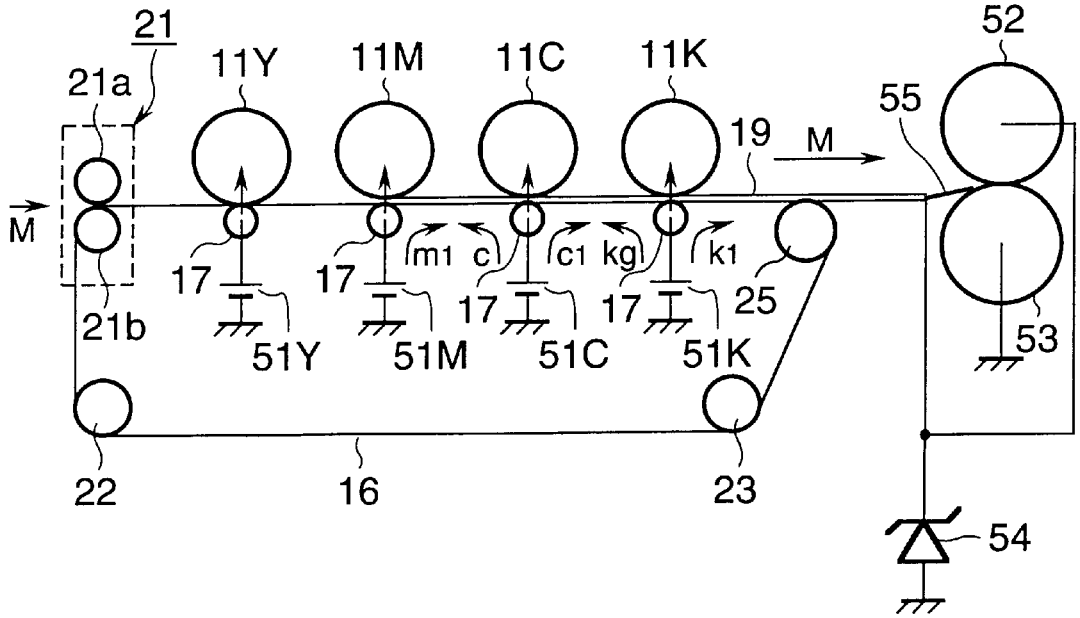
FIG. 14 illustrates the leakage current when a color printing is being performed.

FIG. 14 illustrates the leakage current when a color printing is being performed. The print medium travels in a direction shown by arrows M. Elements of the same construction as those of FIG. 9 have been given the same references.

As previously described, the impedance of the print medium 19 decreases in the high temperature and high humidity environment, and leakage current tends to flow through the print medium 19. However, leakage currents are cancelled out through the print medium 19 between adjacent transfer sections. Once the print medium 19 has left the transfer section for cyan, the transfer operation is performed only at the transfer section for black, and just as in the black printing, the apparent transfer roller voltage $Tr_K$ decreases corresponding to the decrease in the impedance for the print medium 19.

For color printing, yellow, magenta, and cyan toner images are transferred on the print medium 19 before the black toner image is transferred to the print medium 19. At the transfer section for black, the transfer current that flows in the direction of thickness of the print medium 19 is limited by the yellow, magenta, and cyan toner images which have transferred on the print medium.

Thus, the apparent transfer roller voltage $Tr_K$ applied to the transfer roller 17 for black will further decrease to the value Va3 (FIG. 13) which is outside of the range AR1. This decreases transfer effect at the transfer section for black.

The transfer roller voltage $Tr_K$ is the same for color printing and black printing.

Second Embodiment

In the aforementioned first embodiment, when black printing or color printing is performed in the high temperature and high humidity environment, the apparent transfer voltage $Tr_K$ decreases after the rearward end of the print medium 19 has left the transfer section for cyan. Thus transfer effect at the transfer section for black is decreased, resulting in poor print quality.

A second embodiment solves the problem that the print quality decreases in the high temperature and high humidity environment. Elements of the same construction as those of the first embodiment have been given the same references and description thereof is omitted.

In order to solve the problem, transfer roller voltage $Tr_K$ is changed by adding a correction voltage to the transfer voltage Va. The correction voltage ranges from 10 to 20% of the transfer voltage Va, depending on the conditions of the environment and the print medium 19. In the second embodiment, the moisture content in the air is estimated on the basis of the humidity detected by the humidity sensor 35 and the temperature detected by the temperature sensor 34.

FIG. 15 is Table I illustrating environmental conditions and corresponding corrected voltages. The environmental conditions are grouped into 8 different levels expressed by environments 1 to 8 from a high temperature-and-high humidity side to a low temperature-and-low humidity side, and the environments are assigned corresponding correction voltages. The correction voltages become progressively high as the high temperature-and-high humidity side is approached. The correction voltages are decreased or set to zero volts as the low temperature-and-low humidity side is approached.

FIG. 16A is Table II illustrating environments and corresponding temperature ranges and humidity ranges.

FIG. 16B is Table III that lists environments and corresponding correction voltage levels.

As shown in FIG. 16A, the temperature and humidity are divided into 9 steps, respectively. A combination of the detection signals of the temperature and humidity determines an environment in FIG. 16A, i.e., an environment in which the print medium and the transfer belt is placed. Then, a correction voltage corresponding to a determined environment is determined according to Table III shown in FIG. 16B.

Figure 17:
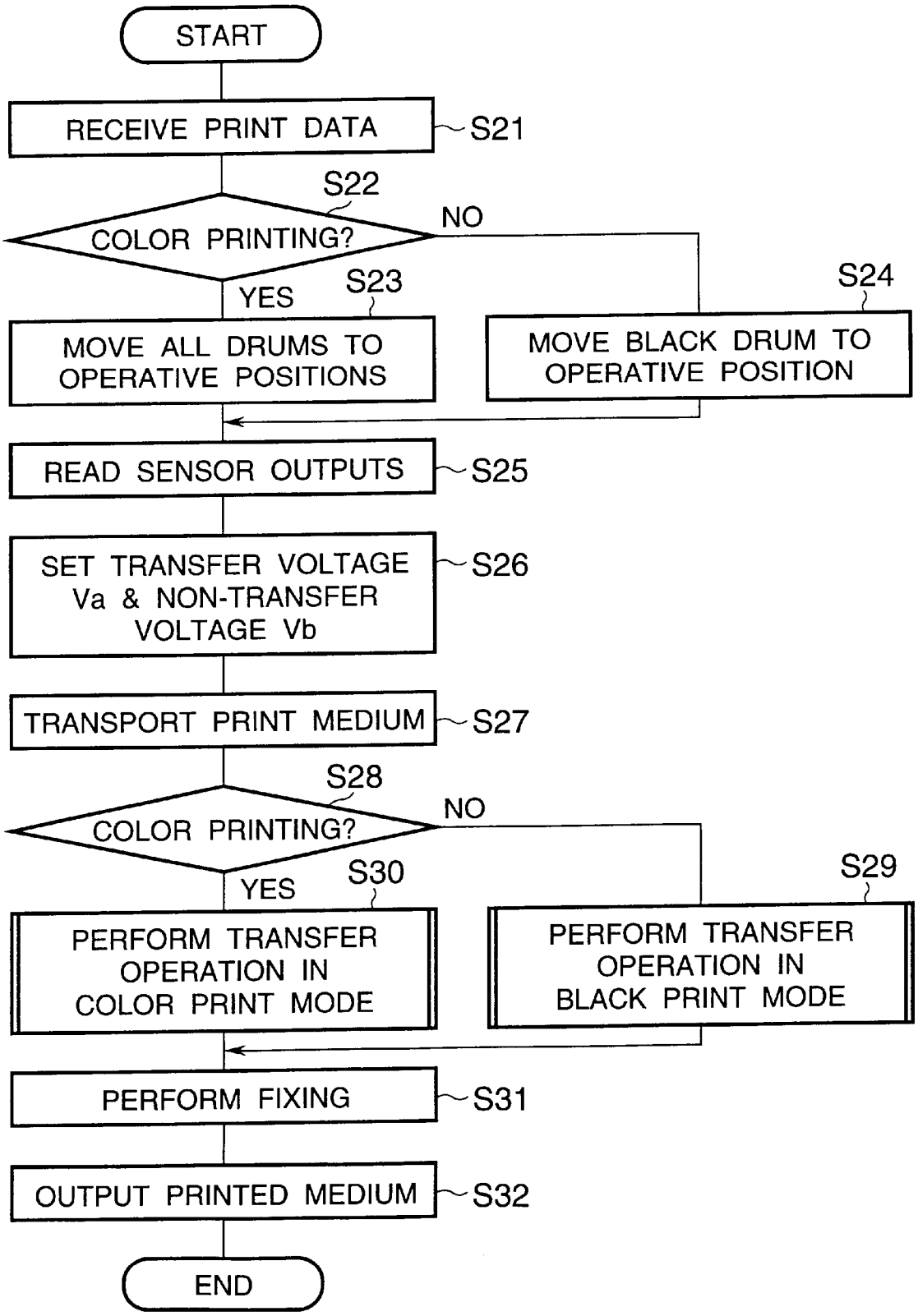
FIG. 17 is a main flowchart illustrating the operation of an electrophotographic printer according to the second embodiment.

FIG. 17 is a main flowchart illustrating the operation of an electrophotographic printer according to the second embodiment.

Referring to FIG. 17, when the controller 33 (FIG. 4) receives commands and print data from the host computer 31 at step S21, the controller 33 checks the commands at step S22 to determine whether the printing is color printing or black printing. If the printing is color printing, the program proceeds to step S23 where the controller 33 causes drive means, not shown, to move the photoconductive drums 11Y, 11M, 11C, and 11K to their operative positions. If the printing is black printing at step S22, the program proceeds to step S24 where the controller causes the drive means to move the photoconductive drums 11Y, 11M, and 11C to their non-operative positions and the photoconductive drum 11K to its operative position.

Then, at step S25, the high voltage setting section 37 reads the detection signals of the temperature sensor 34 and the humidity sensor 35, and sets at step S26 the transfer voltage Va and non-transfer voltage Vb in accordance with the detection signals. In other words, the transfer voltage Va and non-transfer voltage Vb are corrected according to Table I shown in FIG. 15. Then, at step S27 the controller 33 outputs an instruction to the motor driver 39, and the motor driver 39 drives the transport belt 16 to transport the print medium 19.

A check is made at step S28 to determine whether the printing is color printing. If the printing is color printing (YES at step S28), then the program proceeds to step S30 where the controller 33 starts the transfer operation in the color print mode. If the printing is black printing (NO at step S28), the program proceeds to step S29 where the controller 33 starts the transfer operation in the black print mode.

The fixing operation is preformed for the color image or black image at step S31.

At step S32, when the transfer operations for toner images of all the colors have completed, the print medium 19 is separated from the transfer belt 16 and advanced to the fixing unit. At step S32, the print result is outputted.

Transfer Operation for Black

The transfer operation for black will be described.

The high voltage outputting section 38 applies the transfer roller voltages $Tr_Y$, $Tr_M$, $Tr_C$, and $Tr_K$ (=Vb) to the transfer rollers 17 for yellow, magenta, cyan, and black. The print medium 19 passes through the transfer section for yellow, magenta, and cyan images to the transfer section for black. When the forward end of the print medium 19 arrives at the transfer section for black, the high voltage outputting section 38 applies the transfer roller voltage $Tr_K$=Va to the transfer roller 17 for black.

When the rearward end of the print medium 19 leaves the transfer section for cyan, the high voltage setting section 37 corrects the transfer roller voltage $Tr_K$=Va with the correction voltage and the high voltage outputting section 38 applies the corrected transfer roller voltage $Tr_K$ to the transfer roller 17 for black. When the rearward end of the print medium 19 leaves the transfer section for black, the high voltage outputting section 38 applies the transfer roller voltage $Tr_K$=Vb to the transfer roller 17 for black.

Subroutine for Black Printing

Figure 18:
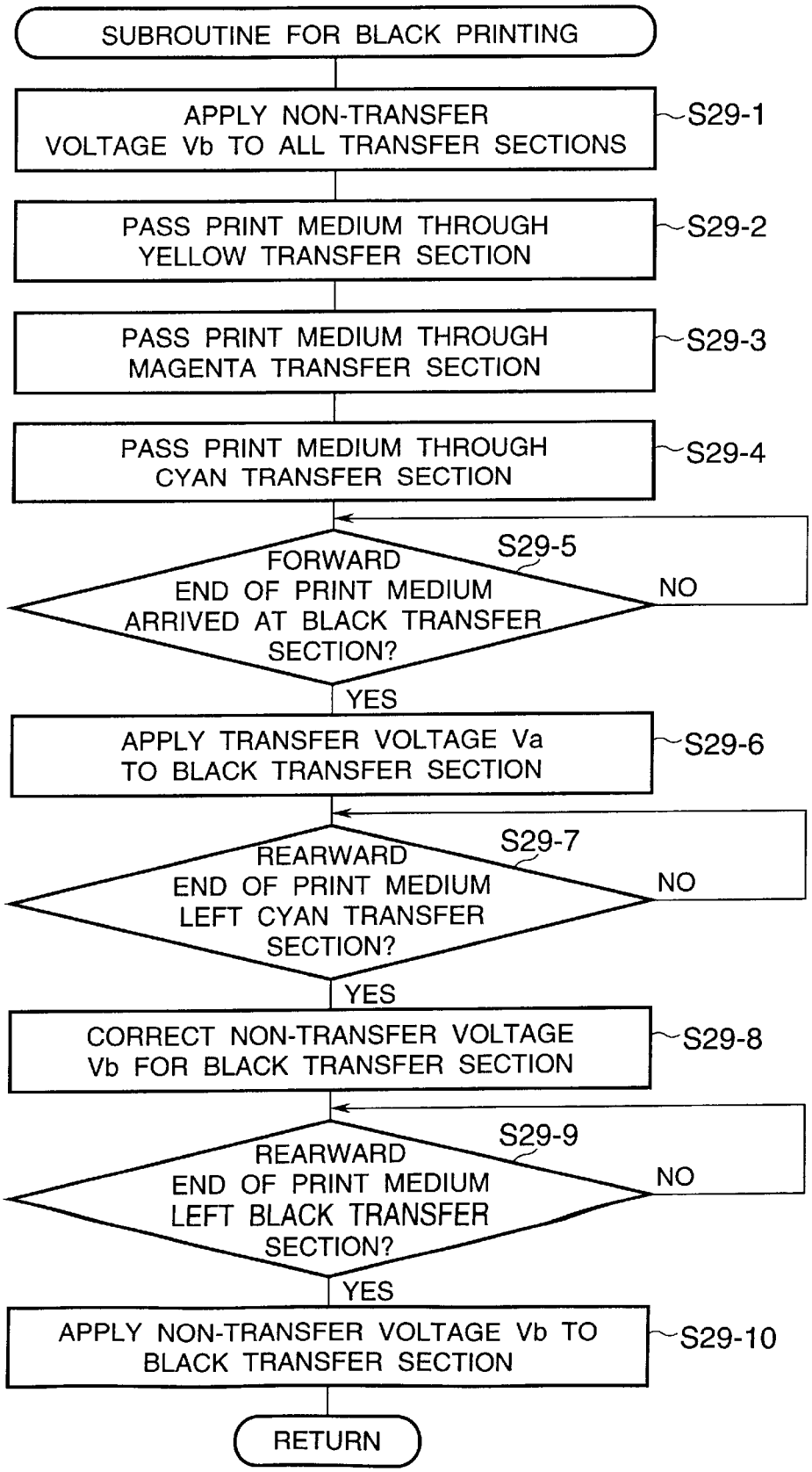
FIG. 18 is a subroutine of the transfer operation in a black print mode.

FIG. 18 is a subroutine of the transfer operation in a black print mode. The flowchart of FIG. 18 will now be described.

Step S29-1: The high voltage outputting section 38 applies the transfer roller voltages $Tr_Y$, $Tr_M$, $Tr_C$, and $Tr_K$ (=Vb) to the respective transfer sections.

Step S29-2: The print medium 19 passes the transfer section for yellow.

Step S29-3: The print medium 19 passes the transfer section for magenta.

Step S29-4: The print medium 19 passes the transfer section for cyan.

Step S29-5: The program waits till the forward end of the print medium 19 arrives at the transfer section for black.

Step S29-6: The high voltage outputting section 38 applies the transfer roller voltage $Tr_K$=Va to the transfer section for black.

Step S29-7: The program waits till the rearward end of the print medium 19 leaves the transfer section for cyan.

Step S29-8: The high voltage setting section 37 corrects the transfer voltage $Tr_K$ with the correction voltage.

Step S29-9: The program waits till the rearward end of the print medium 19 leaves the transfer section for black.

Step S29-10: The high voltage outputting section 38 applies the transfer roller voltage $Tr_K$=Vb to the transfer section for black.

Transfer Operation for Colors

Figure 19:
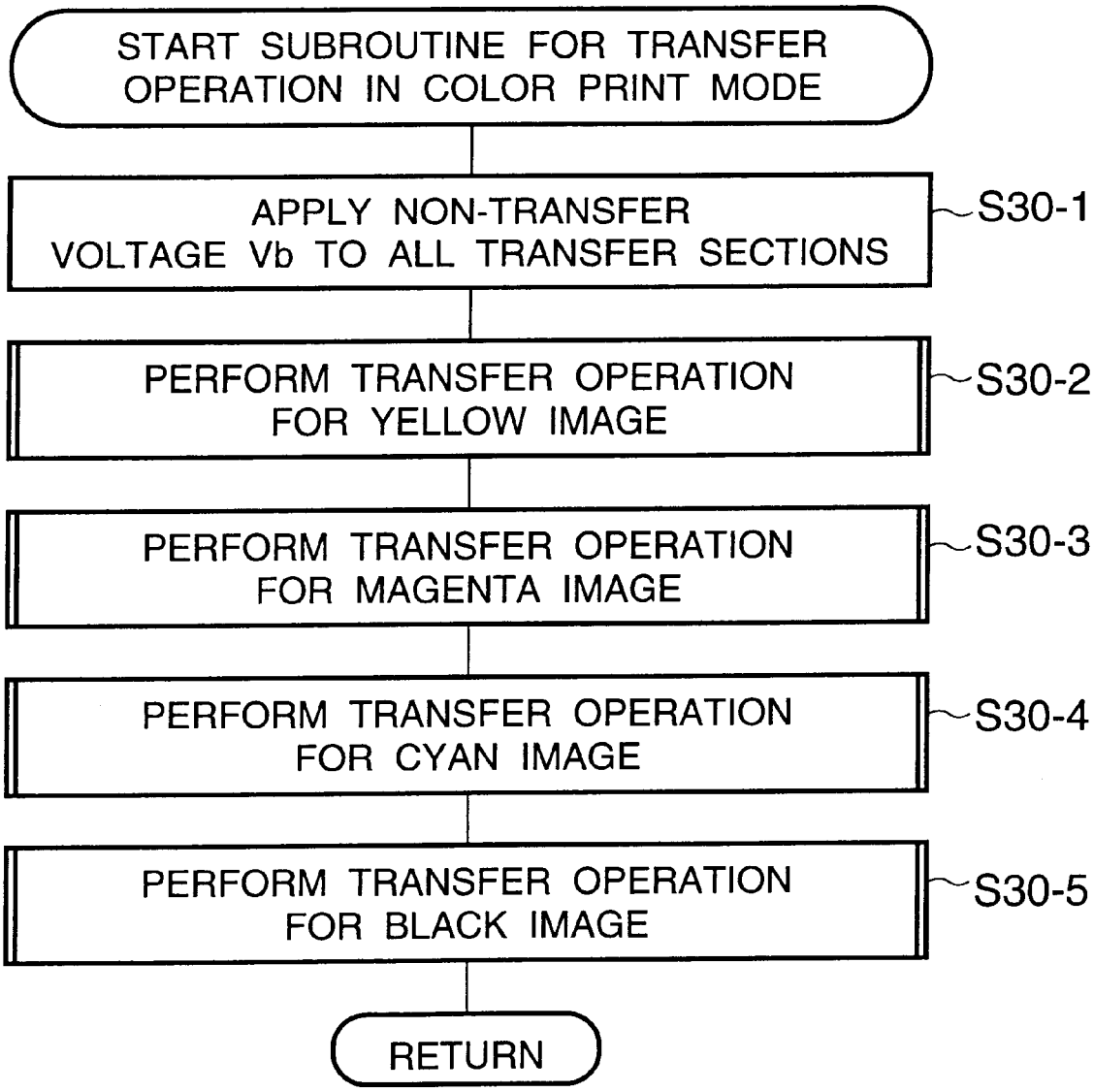
FIG. 19 is a subroutine of the transfer operation in a color print mode.

FIG. 19 is a subroutine of the transfer operation in a color print mode.

The transfer operation in the color print mode will now be described with reference to FIG. 19.

Step S30-1: The high voltage outputting section 38 applies the transfer voltage $Tr_Y$, $Tr_M$, $Tr_C$, and $Tr_K$, (=Vb), to the respective transfer sections for yellow, magenta, cyan, and black.

Steps S30-2 to S30-5: When the forward end of the print medium 19 passes through the transfer sections for yellow, magenta, cyan, and black in this order, the high voltage outputting section 38 performs the transfer operations for yellow, magenta, cyan, and black images, thereby transferring the yellow, magenta, cyan, and black toner images to the print medium.

Transfer Operations for Yellow, Magenta, Cyan, and Black

The transfer operations for yellow, magenta, cyan, and black images will be described.

Figure 20:
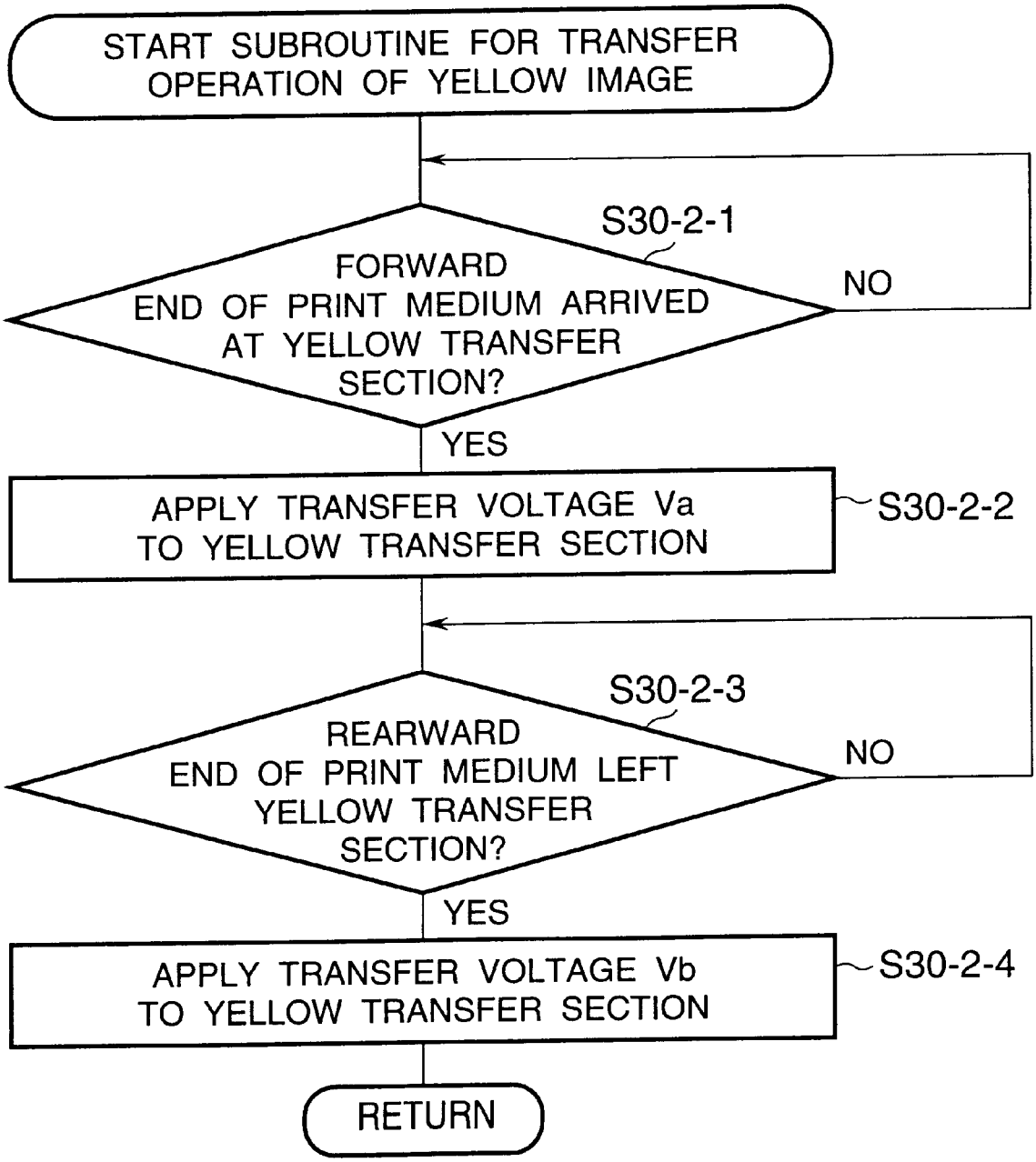
FIG. 20 is a subroutine of the transfer operation for yellow.

FIG. 20 is a subroutine of the transfer operation for yellow.

The flowchart of FIG. 20 will be described with respect to the transfer operation for yellow. The transfer operations for magenta and cyan are the same as that for yellow and the description thereof is omitted.

Step S30-2-1: The controller 33 reads the detection signal of a paper sensor 36 and checks the detection signal to determine whether the forward end of the print medium 19 has reached the transfer section for yellow. If YES at step S30-2-1, the program proceeds to step S30-2-2 where the high voltage outputting section 38 applies the transfer voltage $Tr_Y$=Va to the transfer roller 17 for yellow. A check is made at step S30-2-3 to determine whether the rearward end of the print medium 19 has left the transfer section for yellow. If YES at step S30-2-3, the high voltage outputting section applies the transfer roller voltage $Tr_Y$=Vb to the transfer roller 17 for yellow.

Transfer Operation for Black

Figure 21:
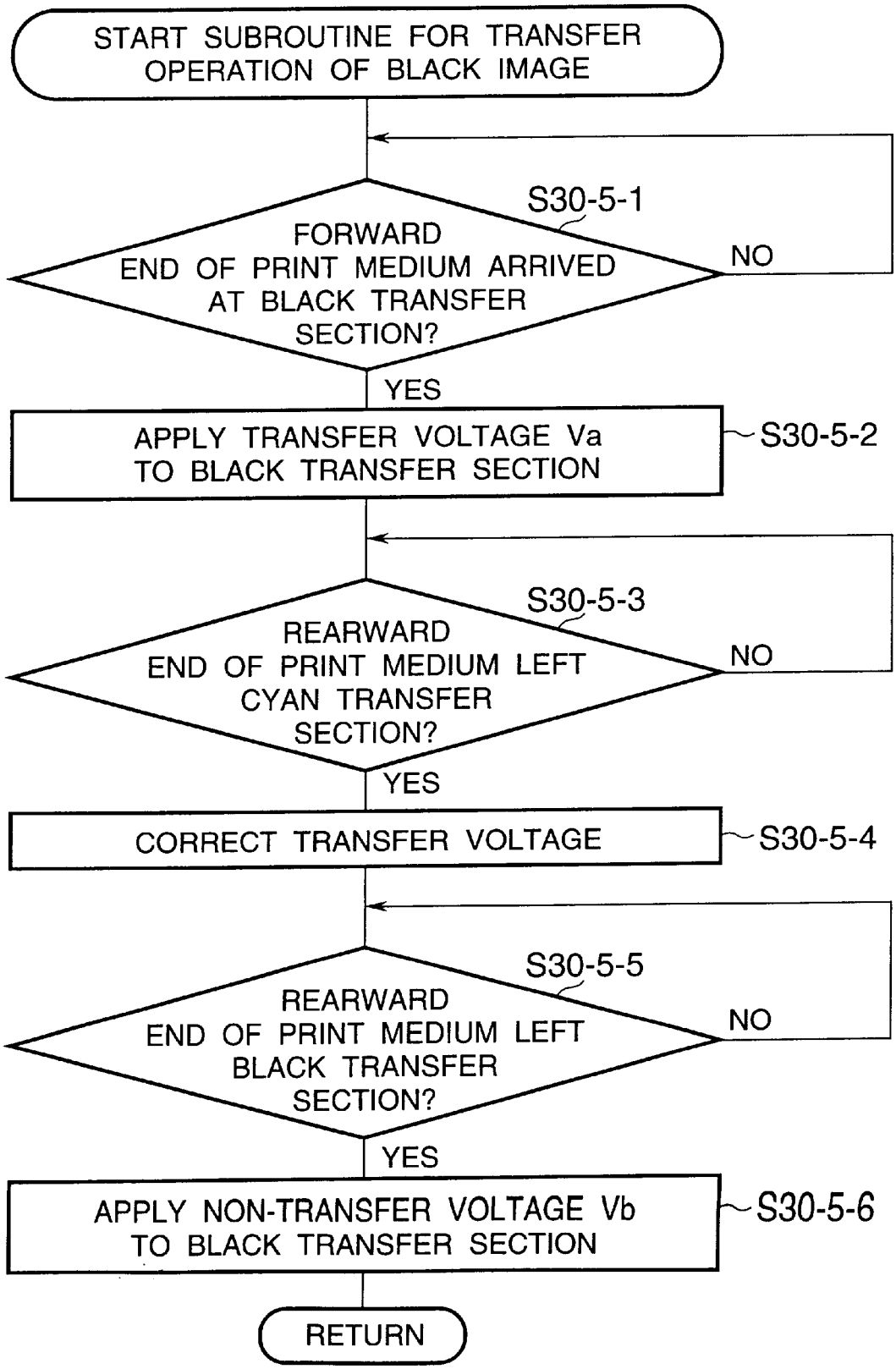
FIG. 21 is a subroutine of the transfer operation for black.

FIG. 21 is a subroutine of the transfer operation for black. The transfer operation for black will be described with reference to FIG. 21.

At step S30-5-1, the controller 33 reads and checks the detection signal of a paper sensor 36 to determine whether the forward end of the print medium 19 has reached the transfer section for black. If YES at step S30-5-1, the high voltage outputting section 38 applies at step S30-5-2 the transfer voltage $Tr_K$=Va to the transfer roller 17 for black.

Subsequently, at step S30-5-3, a check is made to determine whether the rearward end of the print medium 19 has left the transfer section for cyan. If YES at step S30-5-3, the high voltage setting section 37 corrects at step S30-5-4 the transfer voltage $Tr_K$=Va and the high voltage outputting section 38 applies the corrected transfer voltage $Tr_K$ to the transfer roller 17 for black.

At step S30-5-5, a check is made to determine whether the rearward end of the print medium 19 has left the transfer section for black. If YES at step S30-5-5, the high voltage outputting section 38 applies at step S30-5-6 the transfer roller voltage $Tr_K$=Vb to the transfer roller 17 for yellow.

Operation of High Voltage Setting Section

The operation of the high voltage setting section will be described.

Figure 22:
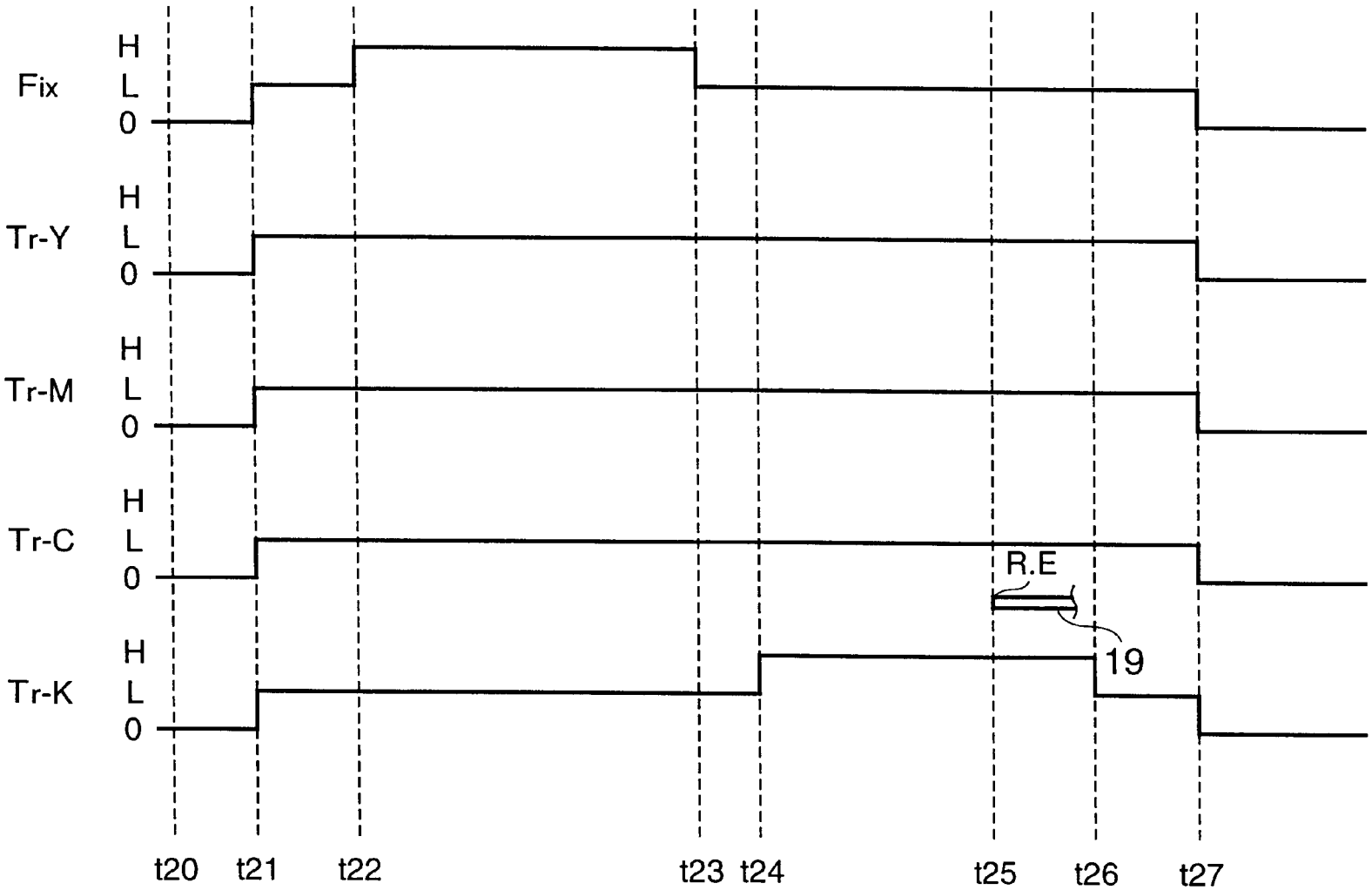
FIG. 22 is a timing chart illustrating the operation of the high voltage setting section when performing black printing.

FIG. 22 is a timing chart illustrating the operation of the high voltage setting section 37 when performing black printing.

As shown in FIG. 22, when a printing is activated at time t20, the high voltage setting section 37 (FIG. 4) sets at time t21 the attraction voltage $F_{ix}$, which is applied to the attraction section 21, to a low level L. The high voltage setting section 37 also sets the transfer voltages $Tr_Y$, $Tr_M$, $Tr_C$, and $Tr_K$ to a low level (=Vb) at time t21.

At time t22, the voltage setting section 37 sets the attraction voltage $F_{ix}$ to a high level H, then to a low level at time t23, finally to zero volts at time 27. At time t24, the voltage setting section 37 sets the transfer roller voltage $Tr_K$ to the transfer voltage Va.

When the rearward end (R.E) of the print medium 19 (FIG. 9) leaves the transfer section for cyan at time t25, the high voltage setting section 37 corrects the transfer roller voltage $Tr_K$ with correction voltage shown in FIG. 15. Then, the high voltage setting section 37 sets the transfer roller voltage $Tr_K$ to a low level (=Vb) at time t26 and the transfer roller voltages $Tr_Y$, $Tr_M$, $Tr_C$, and $Tr_K$ to zero volts at time t27.

Color Print Mode

Figure 23:
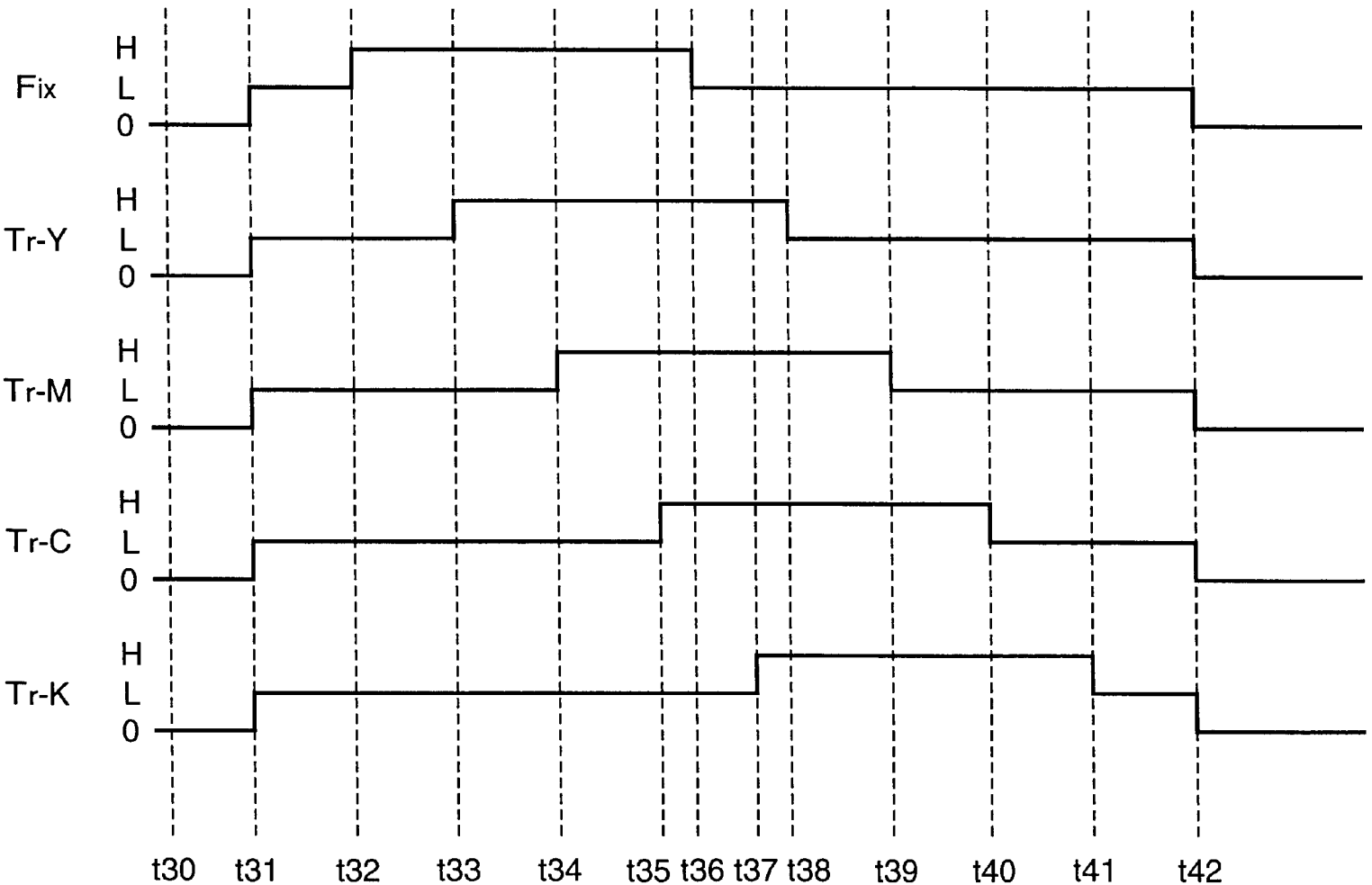
FIG. 23 is a timing chart illustrating the operation of the high voltage setting section when performing color printing.

FIG. 23 is a timing chart illustrating the operation of the high voltage setting section 37 when performing color printing.

Next, the color print mode will be described with reference to FIG. 23.

As shown in FIG. 22, when a printing is activated at time t30, the high voltage setting section 37 sets the attraction voltage $F_{ix}$, which is applied to the attraction section 21, to a low level at time t31, a high level at time t32, the low level again at time t36, and finally to zero volts at time t42.

The high voltage setting section 37 sets the transfer roller voltages $Tr_Y$, $Tr_M$, $Tr_C$, and $Tr_K$ to a high level (=Va) at times t33, t34, t35 and t37. Times t33, t34, t35, and t37 are timings at which the forward end of the print medium arrives at the transfer points P for yellow, magenta, cyan, and black images, respectively. Then, the transfer voltages $Tr_Y$, $Tr_M$, $Tr_C$, and $Tr_K$ are then set to the low level (non-transfer voltage Vb) at times t38, t39, t40, and t41. Times t38, t39, t40, and t41 are timings at which the rearward end of the print medium leaves the transfer points P for yellow, magenta, cyan, and black images, respectively.

At time t42, the transfer voltages $Tr_Y$, $Tr_M$, $Tr_C$, $Tr_K$, and $Tr_M$ are set to zero volts.

In this manner, if a printing is performed in a high temperature-and-high humidity environment, the transfer voltage $Tr_K$ is increased by 10 to 20% when the rearward end of the print medium 19 has left the transfer point for cyan. This prevents decreases in transfer effect at the rearward end portion of the print medium 19, thereby maintaining print quality.

Third Embodiment

The second embodiment has been described with respect to a case where a single page of print medium 19 is printed in the high temperature and high humidity environment. When a continuous printing is performed, poor transfer result may occur depending on the conditions of toner in the developing unit.

Figure 24:
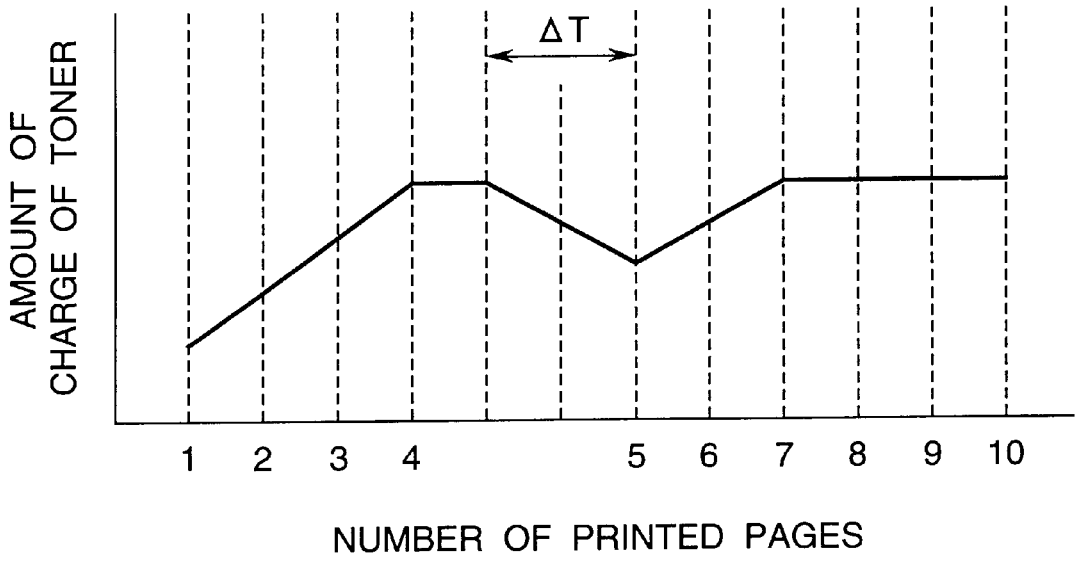
FIG. 24 illustrates the relationship between the number of pages of printed medium and the charging of the toner in a third embodiment.

FIG. 24 illustrates the relationship between the number of pages of printed medium and the charging of the toner. FIG. 24 plots the number of printed pages of printed medium as the abscissa and the amount of charge of toner as the ordinate.

The toner in the developing unit is agitated during printing. The toner is then charged as the developing roller 14 (FIG. 1) and toner supplying roller 15 are rotated. The amount of charge of the toner increases with increasing number of printed pages. A length of time ΔT is an interval during which the toner is not agitated and the developing roller 14 and the toner supplying roller 15 are not rotated.

If the amount of charge increases with increasing number of printed pages, stable transfer operation is impaired, resulting in poor transfer results.

A third embodiment is directed to a printer which prevents poor transfer results during continuous printing.

Figure 25A:
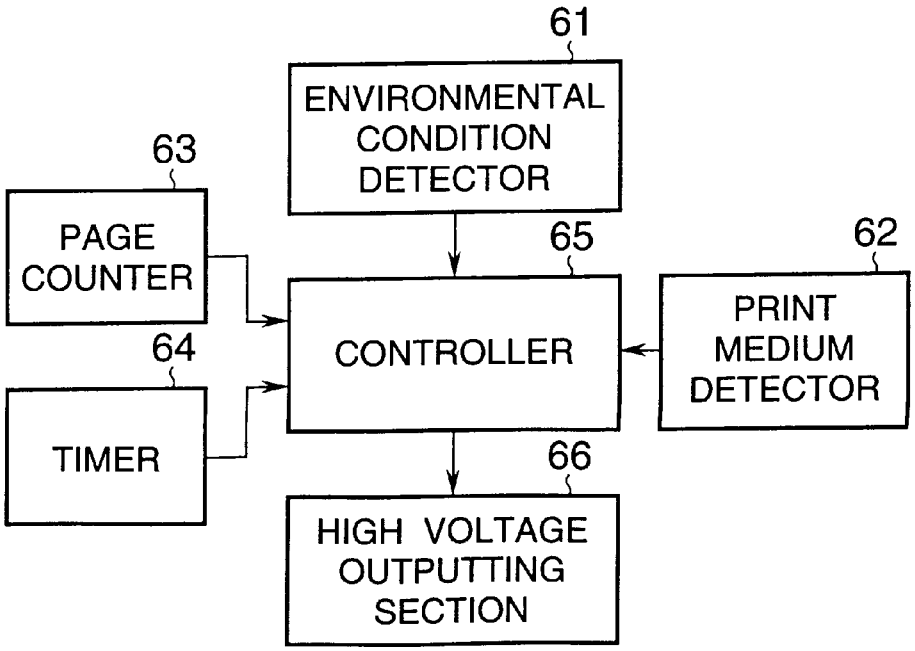
FIG. 25A is a diagram showing a controller of an electrophotographic printer according to the third embodiment.

FIG. 25A is a diagram showing a controller of an electrophotographic printer according to the third embodiment.

Referring to FIG. 25A, an environmental condition detector 61 takes the form of, for example, a temperature sensor 34 (FIG. 4) and a humidity sensor 35. Other detecting means may be used in place of the temperature sensor 34 and humidity sensor 35. A print medium detector 62 detects the kind of print medium using various signals. Such signals include a command inputted from an operation panel 32, the kind and size of print medium specified by a host computer, and the detection signals of the paper sensors 36 disposed along the transport path of the print medium 19.

A page counter 63 counts the number of cumulative pages from when a printing is activated. A timer 64 detects a length of time τ after completion or interruption of a printing till the next printing is started. The page counter 63 and the timer 64 form a print state detecting means.

A controller 65 receives various items of information from the environmental condition detector 61, print medium detector 62, page counter 63, and timer 64. The controller 65 incorporates a transfer voltage correcting means, not shown. On the basis of these various items of information, the transfer voltage correcting means sets the transfer roller voltages $Tr_Y$, $Tr_M$, and $Tr_C$, which are applied to the transfer rollers 17 for yellow, magenta, and cyan, respectively. The transfer voltage correcting means also determines correction voltages for correcting the transfer roller voltage $Tr_K$ for black. For this purpose, the controller 65 has Tables IV to VII.

FIGS. 25B–25E shows Tables IV to VII which list various settings of correction voltage levels, correction voltages, and transfer voltages according to the kinds of print medium and environmental conditions.

Table IV lists the number of pages and corresponding increments of level of correction voltage. Table V lists lengths of time during which a printing is interrupted and corresponding decrements of level of correction voltage. Table VI lists correction voltage levels and corresponding kinds of medium 19. Table VII lists environments and corresponding transfer voltages Va and non-transfer voltages Vb.

Tables IV to VII are designed such that optimum transfer operation can be effected according to experimental data, i.e., changes in environmental conditions and corresponding changes in the characteristics of print medium. A high voltage outputting section 66 applies the transfer roller voltages $Tr_Y$, $Tr_M$, $Tr_C$, and $Tr_K$, which are set by the controller 65, to the corresponding transfer rollers 17.

When a printing is activated, the controller 65 reads the environmental conditions detected by the environmental condition detector 61. Then, on the basis of the detected environmental conditions, the controller 65 estimates the environment in which the transfer belt and the print medium are placed, and sets the transfer roller voltages $Tr_Y$, $Tr_M$, $Tr_C$, and $Tr_K$ corresponding to the estimated environment.

The controller 65 initializes the printer after power on. If the controller 65 determines that the electrophotographic printer is either in a room temperature and room humidity environment or in a low temperature and low humidity, then the print medium 19 is relatively dry and therefore leakage current is difficult to flow. Thus, a correction voltage level is 0, i.e., correction voltage is 0 volts as shown in FIG. 16B. Thus, the transfer roller voltage $Tr_K$ for black is not actually corrected.

The term "correction voltage level" is used to cover levels of correction of transfer voltage, and depends on the environment in which the printer is placed. The term "correction voltage" is used to cover a voltage corresponding to a specific correction voltage level. The correction voltage is added to a transfer voltage. As is clear from FIG. 25D, for the same correction voltage level of "1", the correction voltage can be different depending on the kind of print medium, for example, +100 V for medium #2 and +150 V for medium #3.

If the controller 65 determines that the electrophotographic printer is in the high temperature and high humidity environment, the print medium 19 absorbs the moisture contained in the air so that leakage current is apt to flow through the print medium. Thus, using Table III shown in FIG. 16B, the controller 65 sets one of correction voltage levels 1–4 that corresponds to the detected high temperature and high humidity environment. When the rearward end of the print medium 19 leaves the transfer section for cyan, the high voltage outputting section 66 outputs the transfer roller voltage $Tr_K$ corrected by the correction voltage level.

When a continuous printing is performed, the controller increases the correction voltage level in increments of 1 as the number of printed pages increases. When an intermittent printing is performed, the controller 65 decreases the correction voltage level by 1 after a length of time τ detected by the timer 64, and waits for the next activation of printing. Then, when the timer 64 detects a length of time 2τ, the controller 65 further decreases the correction voltage level by 1. If no printing is activated after the timer 64 detects a length of time 3τ, then the controller 65 again reads the environmental conditions detected by the environmental condition detector 61, and sets the initial correction voltage level.

This mode of control is effected if the correction voltage level greater than level 0 is set shortly after the printer is initialized. If the correction voltage level is initially set to level 0, the correction voltage level remains level 0 even if a continuous printing is performed.

The operation of the electrophotographic printer of the aforementioned construction will be described with reference to FIG. 26–27.

Figure 26:
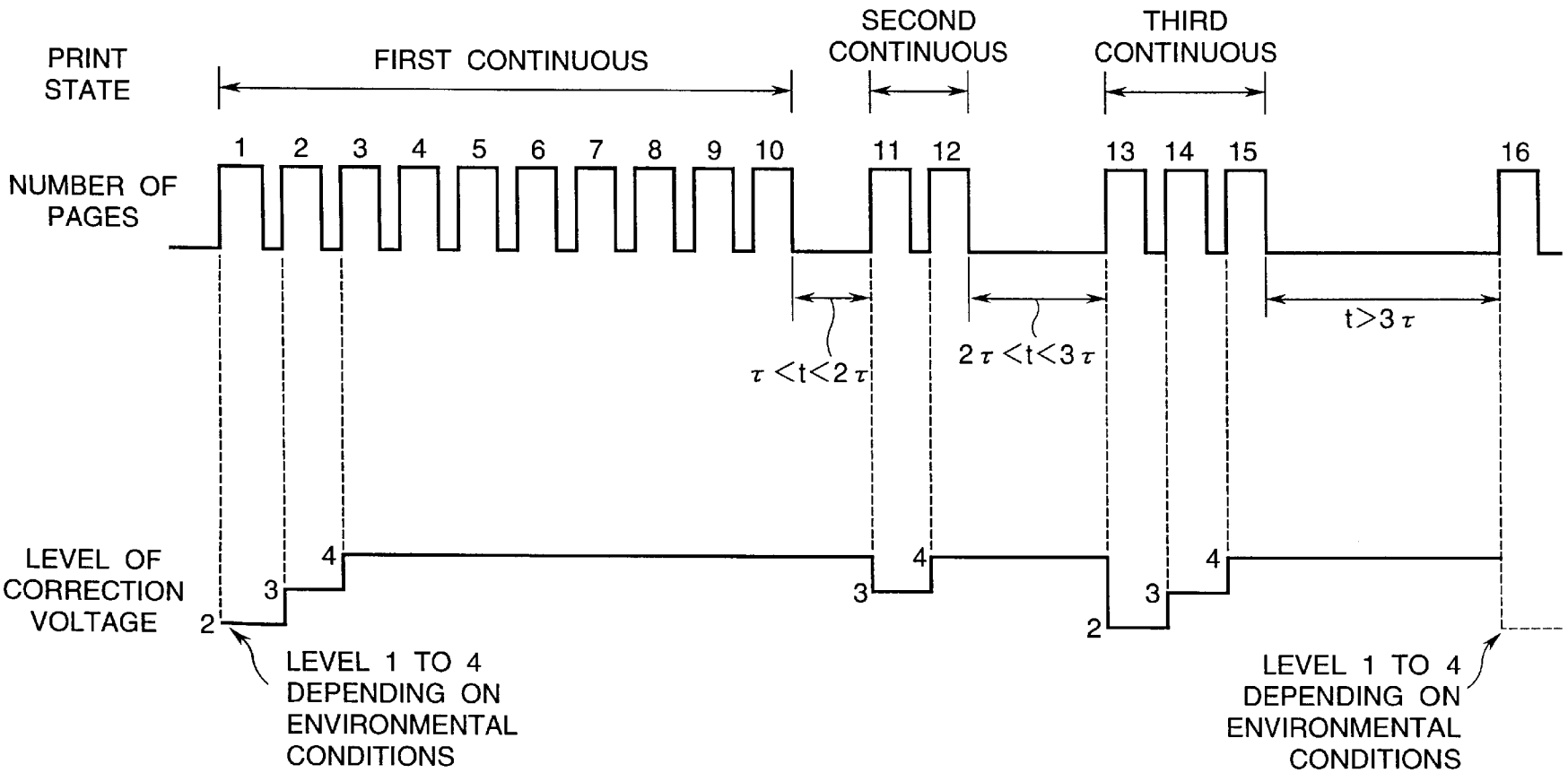
FIG. 26 illustrates the relationship between the number of pages and corresponding correction voltage levels when continuous printings are performed in a high temperature and high humidity environment.

FIG. 26 illustrates an example of the relationship between the number of pages and correction voltage levels when a continuous printing is performed in the high temperature and high humidity environment.

FIG. 26 assumes that, for example, the initial correction voltage level is level 2 for the detected environments and a printing is performed for a total of 16 pages. In other words, the printing is performed for 10 pages in a first continuous printing mode, 2 pages in a second continuous printing mode, 3 pages in a third continuous printing mode, and a single page after the third continuous printing mode.

Correction voltage level 0 indicates that correction voltage is +0 V, and is used both in the room temperature and room humidity environment and in the low temperature and low humidity environment. Correction voltage differs for the same correction voltage level depending on the kind of print medium. As is clear from FIG. 25D, for example, the correction voltages are +50 V, +150 V, +250 V, and +350 V for correction voltage levels 1, 2, 3, and 4, respectively, for medium #1. The correction voltages are +100 V, +200 V, +300 V, and +400 V for correction voltage levels 1, 2, 3, and 4, respectively, for medium #2. The correction voltages shown in FIG. 25D are used in the high temperature and high humidity environment. The transfer roller voltage $Tr_K$ shown in FIG. 23 (i.e., Va for t37–t41 and Vb for t31–t37 and t41–t42), applied to the transfer roller 17 (FIG. 9) for black, is increased by a correction voltage according to the correction voltage levels 1–4 shown in FIG. 25D.

FIG. 27 is a flowchart illustrating the operation of the electrophotographic printer according to the third embodiment in the high temperature and high humidity environment.

At step S41, the printing operation of the electrophotographic printer is activated. At step S42, the controller 65 (FIG. 25A) reads environmental conditions from the environmental condition detector 61 to estimate an environment (FIG. 16A) in which the electrophotographic printer is placed. The controller 65 then estimates at step S43 a correction voltage level (FIG. 25D) corresponding to the estimated environment by referring to Table III shown in FIG. 16B, thereby determining a correction voltage corresponding to the voltage correction level. Then, the controller 65 corrects at step S44 the transfer roller voltages $Tr_Y$, $Tr_M$, $Tr_C$, and $Tr_K$ by the correction voltage. In other words, the correction voltage is added to the transfer roller voltages. The correction voltage level is assumed to be 2 in this example as shown in FIG. 26.

At step S45, a printing is effected for the first page of ten pages in the first continuous printing mode. The yellow, magenta, and cyan images are printed on the first page using the transfer roller voltages $Tr_Y$, $Tr_M$, and $Tr_C$. At step S46, a check is made to determine whether print data for the next page has been received within 3 τ. If the answer at step S46 is NO, it means that the printing operation includes only one page, and the program ends at step S58. If YES at step S46, then the program proceeds to step S47 where a check is made to determine whether the printing is in the continuous printing mode. The continuous printing mode is such that print data for a following page of consecutive pages is received within a period shorter than a length of time τ after a preceding page has been printed. The value of τ is assumed to be 10 seconds in the third embodiment.

At step S48, a check is made to determine whether the correction voltage level is a maximum value (i.e., 4).

At step S49, the voltage correction level is incremented by 1 to 3 and the program loops back to step S45. Steps S45–S49 are repeatedly carried out until 10 pages have been printed in the first continuous printing mode. After having printed the 10th page at step S45, a check is made at step S47 to determine whether the printing is in the continuous printing mode. If the answer at step S47 is NO, then the program proceeds to step S50 where a check is made to determine whether an elapsed time is equal to or longer than τ. As is clear from FIG. 26, the eleventh page is printed after τ but before 2 τ, and therefore the answer at step S50 is YES. Then the program proceeds through S51 to step S52 where a check is made to determine whether the correction voltage level is a minimum. As shown in FIG. 2, the initial correction level is 2 and becomes 4 at the end of the printing of tenth page 6. Thus, the answer at step S52 is NO and the program proceeds to step S53 where the correction voltage level is decremented by 1 to 3. Then, the program jumps to step S45 for printing the eleventh page. After having printed the eleventh page, the correction voltage level is incremented by 1 to 4 at step S49.

Then, after printing the twelfth page at step S45, a check is made at step S47 to determine whether the printing is in the continuous printing mode. From FIG. 26, the print data for the third continuous printing mode (13th–15th pages) is received after 2 τ but before 3 τ. Therefore, the answers at step S50 and S51 are YES but the answer at step S54 is NO. Thus, the program proceeds to step S55. Since the correction voltage level is 4 after printing twelfth page, the answer at step S55 is YES. Then, the correction voltage level is decremented by 2 to 2 at step S56 and the program jumps to step S45 for printing the thirteenth page. Steps S45–S49 are repeatedly carried out till the fifteenth page has been printed at step S45. Then, a check is made at step S47 to determine whether the printing is in the continuous printing mode. Since print data for the sixteenth page is received longer than 3 τ after printing the fifteenth page, the answer at step S47 is NO. Then, the program proceeds through steps S50–S51 and S54 and jumps back to step S42.

In the present embodiment, once the correction voltage level has reached level 4, the correction voltage level will not exceed level 4, not responding to an instruction to increment the correction voltage level. Likewise, once the correction voltage level has decreased to level 1, the correction voltage level will not decrease below level 1, not responding to an instruction to decrement the correction voltage level. Further, when the correction voltage level is level 0, the level 0 is maintained during the continuous printing mode.

The correction voltage may be changed depending on factors including the number of pages, continuous printing, and intermittent printing. This allows transfer operation to be performed in accordance with changes in toner condition accommodated in the developing unit, preventing poor print results from occurring during the continuous printing mode.

Fourth Embodiment

In the high temperature and high humidity environment of the second embodiment, the transfer voltage $Tr_K$ is increased by 10 to 20% when the rearward end of the print medium 19 leaves the transfer point for cyan. Thus, the transfer effect is prevented from decreasing as the rearward end of the print medium 19 is approached. If leakage current increases, the transfer effect becomes enhanced as the forward end of the print medium 19 is approached. A fourth embodiment solves this problem. Elements of the same construction as those of the first embodiment have been given the same references and description thereof is omitted.

The fourth embodiment will be described with respect to the transfer operation in the black printing mode.

Figure 28:
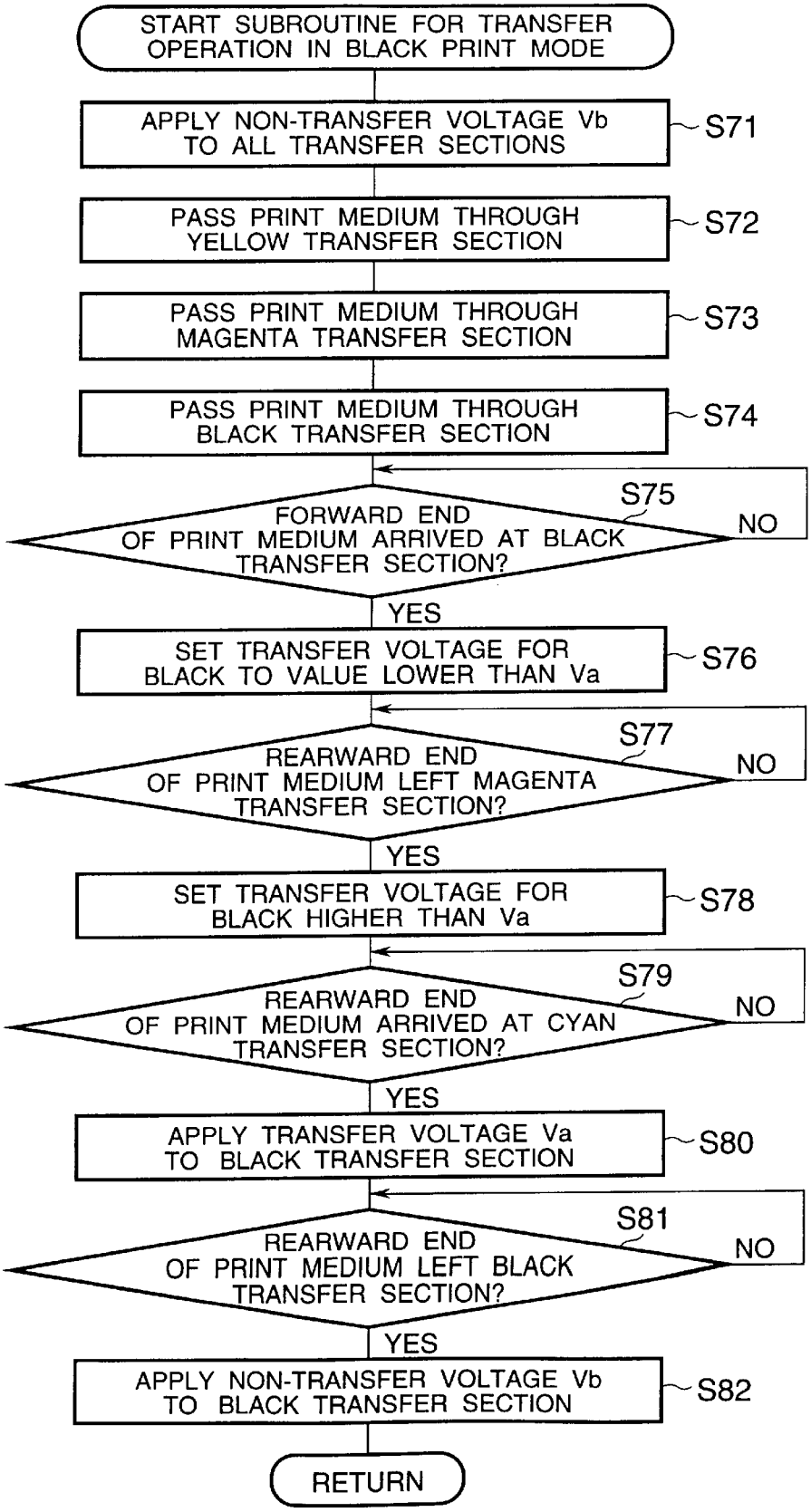
FIG. 28 illustrates a subroutine of the transfer operation in the black print mode in a fourth embodiment.

FIG. 28 illustrates a subroutine of the transfer operation in the black printing mode.

As the transfer belt runs, the print medium 19 attracted to the transfer belt 16 is transported through the transfer sections for yellow, magenta, and cyan. Since a black printing is performed, the photoconductive drums 11Y, 11M, and 11C are moved to their non-operative positions. The print medium 19 passes gaps between the photoconductive drums 11Y, 11M, and 11C and the corresponding transfer rollers 17.

At step S71, all the transfer rollers 17 receive the transfer roller voltage $Tr_Y$, $Tr_M$, $Tr_C$, and $Tr_K$ (=Vb) regardless of whether the print medium 19 is present at or absent from the corresponding transfer sections.

At steps S72–74, the print medium 19 passes through the transfer sections.

At step S75, the program waits until the forward end of the print medium 19 arrives at the transfer section for black, and the transfer roller 17 receives a transfer roller voltage $Tr_K$, which is reasonable for transferring the toner image from the photoconductive drum 11K to the print medium 19. When the print medium 19 has just arrived at the transfer section for black, parts of the print medium 19 is still at the transfer sections for magenta and cyan and therefore leakage current flows from the transfer sections for magenta and cyan to the transfer section for black. Taking this fact into account, the transfer roller voltage $Tr_K$ is set at step S76 to a value about 10 to 20% lower than the transfer voltage Va.

When the print medium 19 is further transported until the rearward end of the print medium 19 leaves the transfer section for magenta at step S77, the transfer roller voltage $Tr_K$ is increased slightly at step S78 to a value about 10% lower than the transfer voltage Va.

Then, the transfer roller voltage $Tr_K$ is set to the transfer voltage Va at step S80 immediately after the rearward end of the print medium 19 leaves the transfer section for magenta at step S79. After the rearward end of the print medium 19 has left the transfer section for black at step S81, the transfer roller 17 for black receives the non-transfer voltage Vb at step S82. Then, the print medium 19 is advanced to the fixing unit where the toner image is fixed.

Figure 29:
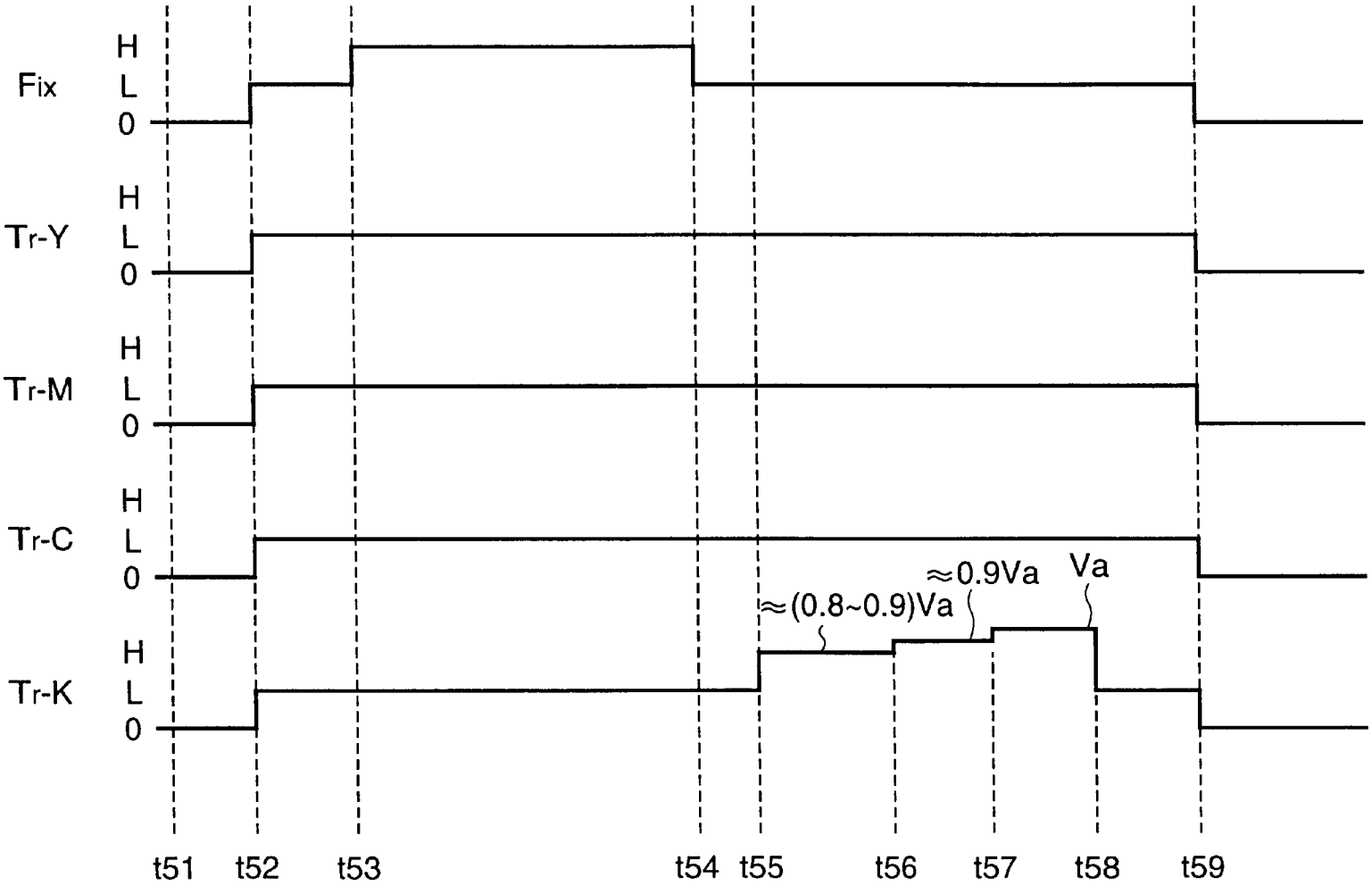
FIG. 29 is a timing chart illustrating the operation of the high voltage setting section in the black print mode.

FIG. 29 is a timing chart illustrating the operation of the high voltage setting section 37 in the black printing mode. FIG. 29 assumes that the print medium is of A4 size or letter size but may be of other sizes.

As shown in FIG. 29, when a printing is activated at time t51, the high voltage setting section 37 (FIG. 4) sets the attraction voltage $F_{ix}$ to a low level and the transfer roller voltages $Tr_Y$, $Tr_M$, $Tr_C$, and $Tr_K$ to a low level (=Vb) at time t52.

The attraction voltage $F_{ix}$ is then set to a high level at time t53, the low level at time t54, and zero volts at time t59. The high voltage setting section 37 sets the transfer roller voltages $Tr_K$, $Tr_M$, and $Tr_C$ to the low level (=Vb) at time t52, and to zero volts at time t59.

The high voltage setting section 37 sets at time t55 the transfer voltage $Tr_K$ to a value about 10 to 20% lower than the transfer voltage Va, and then to a value about 10% lower than the transfer voltage Va at time t56, and finally to the transfer voltage Va at time t57. The transfer voltage $Tr_K$ is then set to the low level at time t58 and to zero volts at time t59. Time t55 is the time when the forward end of the print medium 19 arrives at the transfer section for black. At time t55, the print medium 19 is still at the transfer sections for magenta and cyan and sandwiched between the photoconductive drums and transfer rollers 17 for magenta and cyan. Leakage current flows from transfer sections for magenta and cyan to the transfer section for black, and therefore the leakage current is a maximum.

Thus, in order that the transfer effect is not too strong when the black toner image is transferred to the print medium 19, the transfer roller voltage $Tr_K$ is set to a value about 10 to 20% lower than the transfer voltage Va.

At time t56, the rearward end of the print medium leaves the transfer section from magenta but still at the transfer section for cyan. The leakage current that flows from the transfer section for magenta no longer exists, and therefore leakage current flows only from the transfer section for cyan. Thus, the transfer voltage $Tr_K$ is set to a value about 10% lower than the transfer voltage Va.

At time t57, the rearward end of the print medium 19 leaves the transfer section for cyan, and the leakage current that flows from the transfer section for cyan no longer exists. Thus, the transfer voltage $Tr_K$ is set to the transfer voltage Va. Some leakage current also flows from the transfer section for yellow to the transfer section for black but is sufficiently small compared to currents that flow from the transfer sections for magenta and cyan. Thus, the leakage current from the transfer section for yellow does not significantly affect the transfer effect of the black toner image. As described above, the transfer roller voltage $Tr_K$ is changed in three levels. Changing the transfer roller voltage $Tr_K$ in, for example, four or more levels necessitates complicated control.

The transfer voltage $Tr_K$ is set to the low level at time t58. The attraction voltage Fix and the transfer roller voltages $Tr_Y$, $Tr_M$, $Tr_C$, and $Tr_K$ to zero volts at time t59.

In the color printing mode, the photoconductive drums 11Y, 11M, 11C, and 11K are positioned at their operative positions. Therefore, the transfer roller voltages $Tr_Y$, $Tr_M$, $Tr_C$, and $Tr_K$ are of the same value and leakage currents that flow between adjacent transfer sections are cancelled out. Thus, in the color printing mode, changing transfer roller voltage $Tr_K$ in three levels according to the position of the print medium along the transport path of the print medium is not effective at all in controlling the transfer effect.

As mentioned above, in the fourth embodiment, in performing a black printing in an high temperature and high humidity environment, the transfer voltage $Tr_K$ is set a value lower than Va if a large amount of leakage current flows from other transfer sections to the black transfer section. The transfer voltage $Tr_K$ is progressively increased from the value lower than Va with decreasing leakage current. This way of controlling the transfer roller voltage $Tr_K$ prevents the transfer effect from becoming too strong at the forward end of the print medium 19 during black printing.

Fifth Embodiment

If the impedance of the transfer belt 16 decreases, a larger leakage current flows from a transfer section(s) to which the transfer voltage Va is applied, to a transfer section(s) to which the non-transfer voltage Vb is applied.

Figure 30:
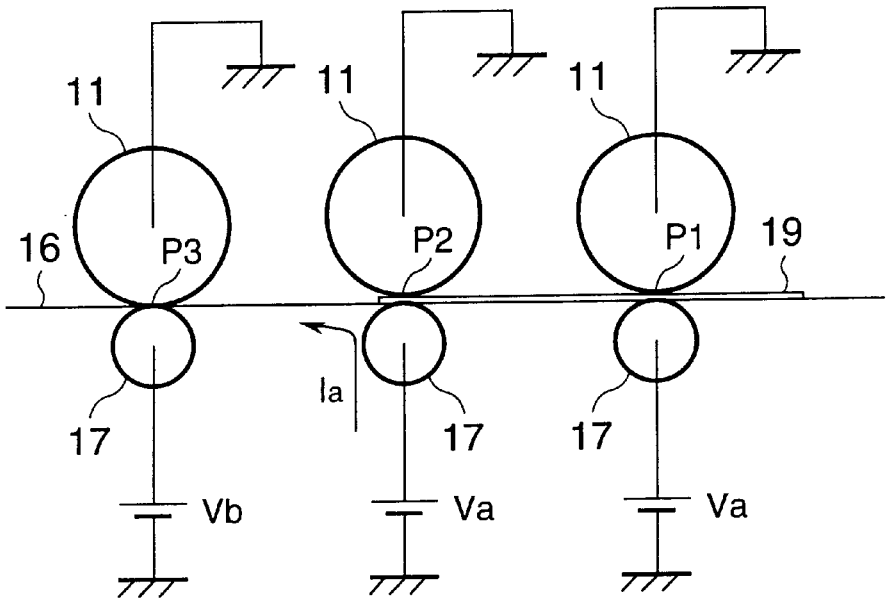
FIG. 30 shows leakage current.

FIG. 30 shows a leakage current Ia.

Transfer points P1 and P2 receive the transfer voltage Va and transfer point P3 receives the non-transfer voltage Vb. A leakage current flows from transfer point P2 to transfer point P3. The potential difference between the Vb and Va increases the leakage current Ia shown by an arrow with decreasing impedance of the transfer belt 16. The increased leakage current prevents a sufficient electric field to be developed between the transfer belt 16 and the photoconductive drum 11, being detrimental to good transfer results.

A fifth embodiment is directed to an electrophotographic printer in which a good transfer effect can be obtained in the high temperature and high humidity environment. Elements of the same construction as those of the first embodiment have been given the same references and description thereof is omitted.

Figure 31:
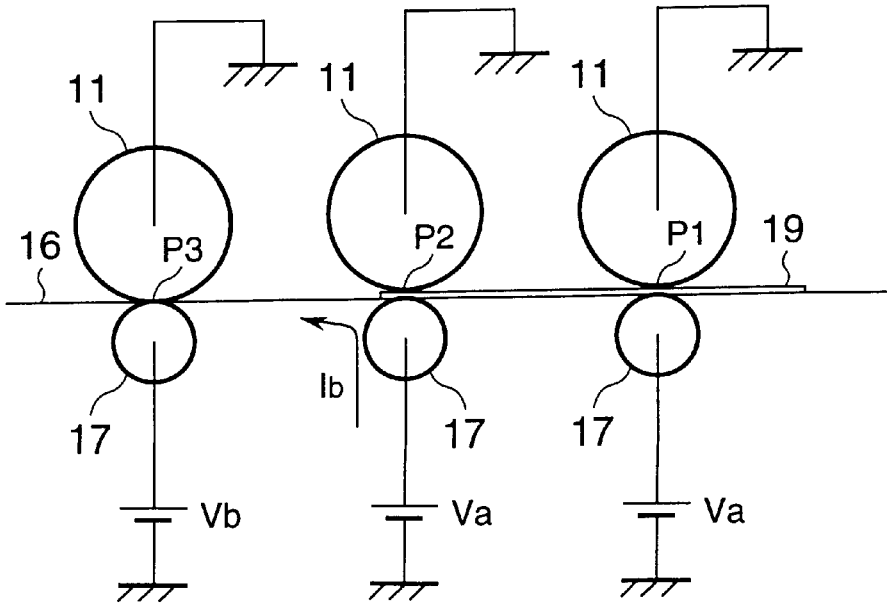
FIG. 31 illustrates the transfer voltages applied to the transfer sections and leakage current in a fifth embodiment.

FIG. 31 illustrates the transfer voltages applied to the transfer sections and a leakage current Ib. The controller 33 checks the detection signals from the temperature sensor 34 and humidity sensor 35 (FIG. 4) to determine whether the printer is placed in the high temperature and high humidity environment. The non-transfer voltage Vb is set to a higher value in the high temperature and high humidity environment than in the low temperature and low humidity environment, so that the potential difference between the transfer voltage Va and the non-transfer voltage Vb is small.

As long as the photoconductive drum 11 is not damaged, the non-transfer Vb is set to as high a value as possible, but is lower than the transfer voltage Va. Thus, the potential difference between the transfer voltage Va and the non-transfer voltage Vb is small, reducing the leakage current Ib that flows from transfer point P2 to the transfer point P3.

Sixth Embodiment

In the first to fifth embodiments, the photoconductive drums 11 not used during a particular printing operation are positioned at their non-operative positions, thereby preventing the photoconductive drums and the transfer belt 16 from deteriorating. For example, the photoconductive drums 11Y, 11M, and 11C are at their non-operative positions in the black printing mode. The photoconductive drum 11K for black is most remotely located from the attraction section 21 (FIG. 3). Thus, the print medium 19 may lose its adhesion to the transfer belt 16 before the print medium 19 arrives at the transfer section for black, depending on the kinds of the print medium 19 and changes in environmental conditions. For this reason, the attraction voltage $F_{ix}$ is set to a higher value so that the print medium 19 is transported to the transfer section for black with good stability.

In contrast, the photoconductive drums 11Y, 11M, 11C, and 11K are all positioned at their operative positions in the color printing mode. The photoconductive drum 11Y is the closest to the attraction section 21 and the respective transfer rollers 17 receive the non-transfer voltage Vb.

Therefore, the attraction voltage $F_{ix}$ set to a low value still allows stable transportation of the print medium 19 to the transfer sections for yellow and subsequently to magenta, cyan, and black transfer sections.

The attraction voltage Fix is set to a high value just as in the black printing mode. This increases not only power consumption but also the cost of the power supply, not shown, for applying the attraction voltage $F_{ix}$ to the attraction section 21.

A sixth embodiment is directed to an electrophotographic printer with features in the black printing mode, including stable transportation of the print medium 19 to the transfer section for black, low power consumption, and low cost of the power supply for outputting the attraction voltage. Elements of the same construction as those of the first embodiment have been given the same references and description thereof is omitted.

Figure 32:
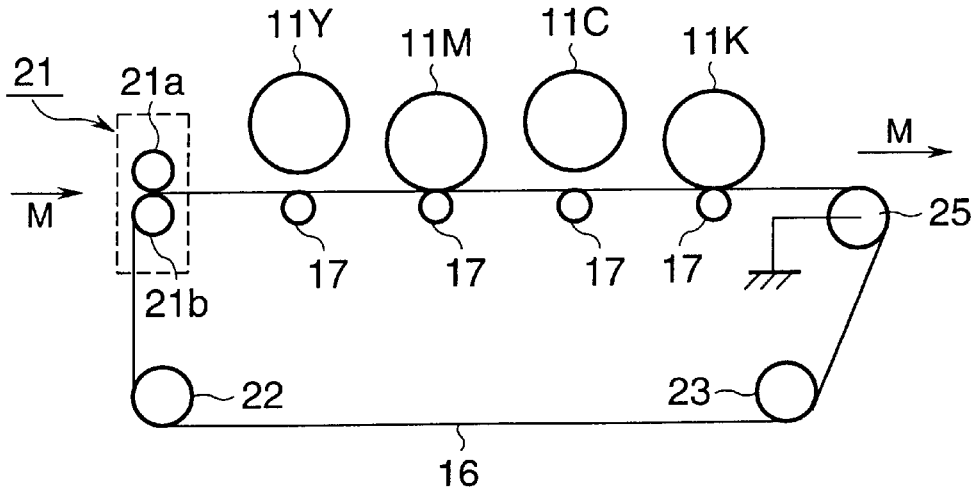
FIG. 32 illustrates an electrophotographic printer according to a sixth embodiment.

FIG. 32 illustrates an electrophotographic printer according to the sixth embodiment. The print medium travels in a direction shown by arrows M.

Figure 33:
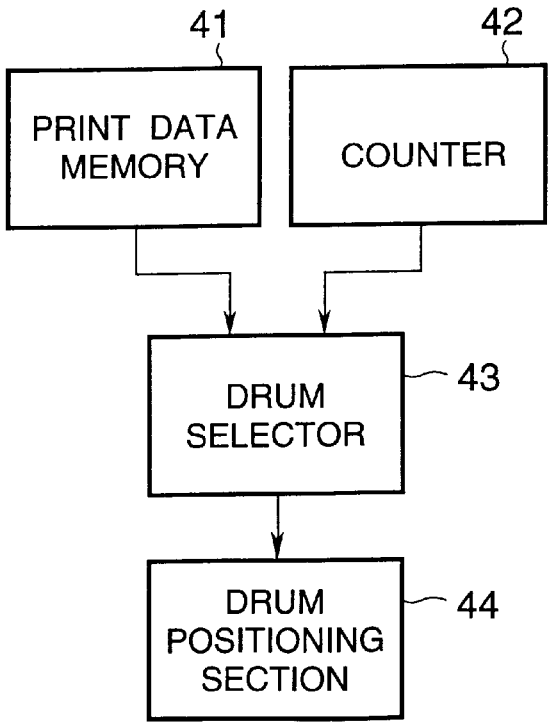
FIG. 33 is a block diagram illustrating the electrophotographic printer of FIG. 33.
Figure 34:
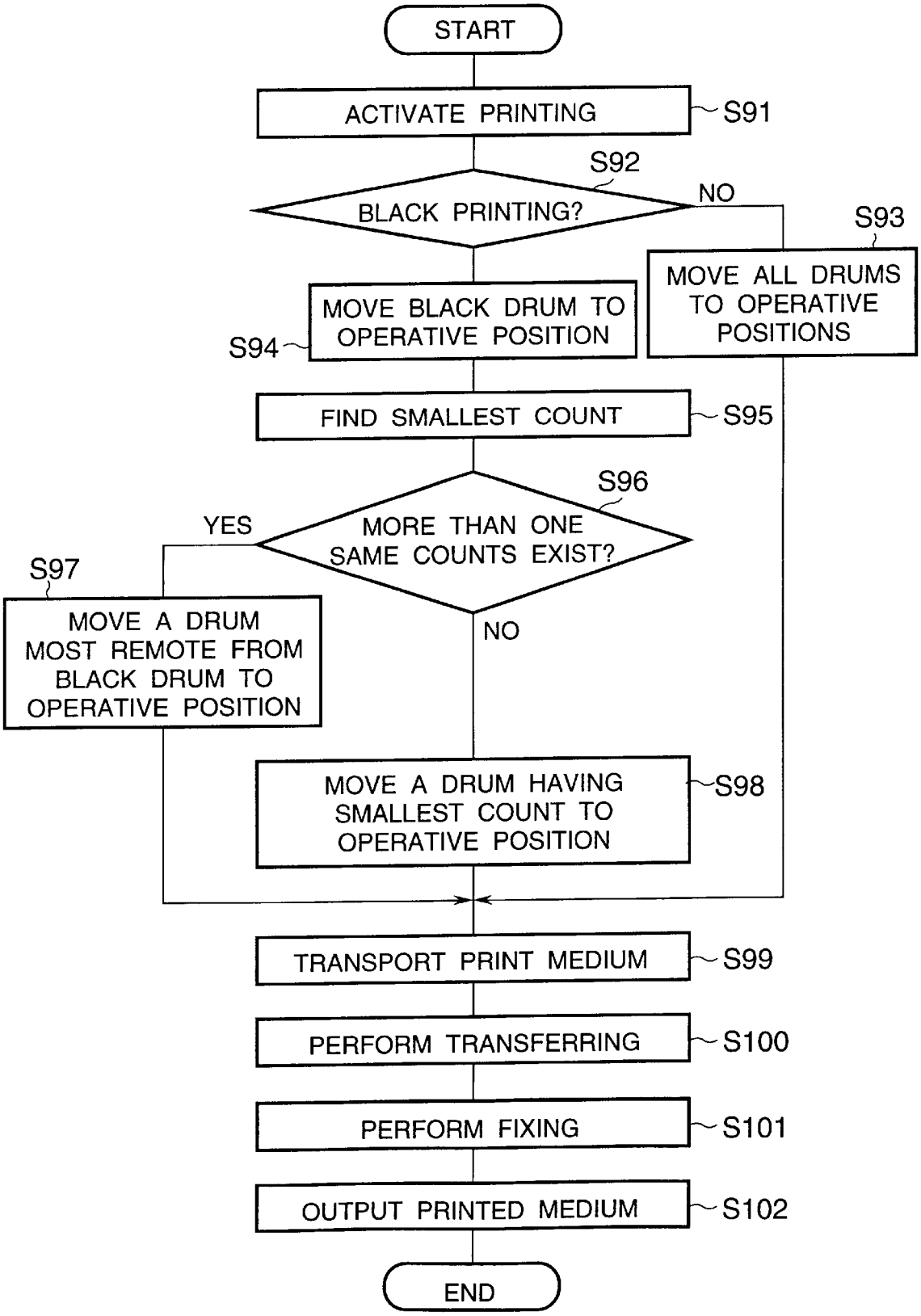
FIG. 34 is a flowchart illustrating the operation of an electrophotographic printer according to the sixth embodiment.
Figure 35:
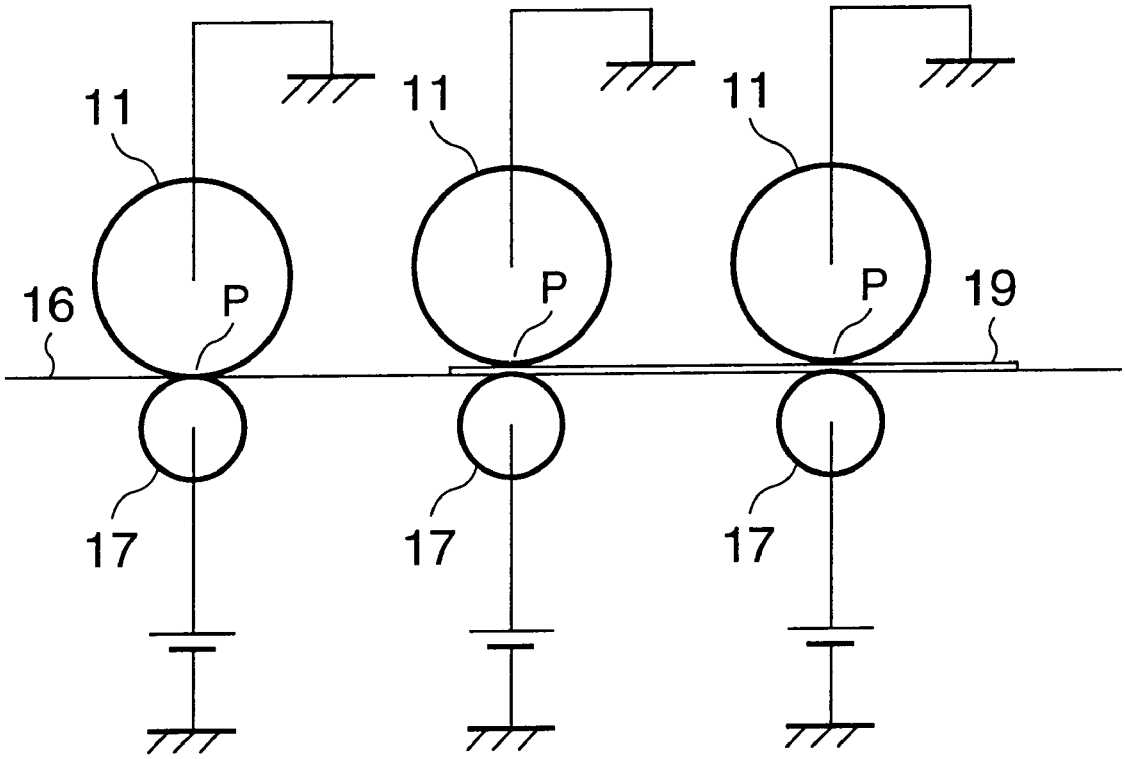
FIG.35 CONVENTIONAL ART
FIG. 35 is a model representation of a relevant portion of a conventional electrophotographic printer.

FIG. 33 is a block diagram illustrating the electrophotographic printer of FIG. 34.

Referring to FIG. 33, a print data memory 41 holds print data for the respective colors. A counter 42 counts the number of cumulative rotations of the photoconductive drums 11Y, 11M, 11C, and 11K in a maintenance mode. A drum selector 43 selects photoconductive drums 11Y, 11M, 11C, and 11K that should be positioned at the operative positions according to the print mode, i.e., color printing or black printing. The drum selector 43 also selects a photoconductive drum having a smallest number of cumulative rotations. A drum positioning section 44 positions the photoconductive drums 11Y, 11M, 11C, and 11K either at their operative positions or at their non-operative positions.

In the monochrome printing mode, a photoconductive drum for a corresponding color is positioned to its operative position and one photoconductive drum having the smallest count is positioned to its operative position. If more than one photoconductive drum have the same smallest count, a photoconductive drum most remote from the photoconductive drum that performs a printing is positioned to its operative position.

For example, a black printing is performed in the monochrome printing mode, the photoconductive drum 11K for black is positioned at its operative position and one of the photoconductive drums 11Y, 11M, and 11C having the smallest count, for example, photoconductive drum 11M. For example, if the photoconductive drums 11M and 11C have the same, smallest count, the photoconductive drum 11M is positioned at its operative position.

FIG. 34 is a flowchart illustrating the operation of an electrophotographic printer.

The operation of the electrophotographic printer of the aforementioned construction will now be described.

When a printing operation is activated at step S91, the drum selector 43 checks at step S92 the print data stored in the print data memory 41 whether a color printing is to be performed or a black printing is to be performed. If a black printing is to be performed, the drum positioning section 44 positions the photoconductive drum 11K at its operative position at step S94.

Next, the drum selector 43 reads counts of the photoconductive drums 11Y, 11M, 11C, and 11K in yellow, magenta, cyan, and black from the counter 42 and finds the smallest count at step S95. Then, the drum selector 43 causes a photoconductive drum having the smallest count to be positioned at its operative position, so that the photoconductive drum serves as an "auxiliary attraction roller". At step S96, if more than one photoconductive drums have the smallest count, or all of the photoconductive drums 11Y, 11M, 11C, and 11K have the same count, a photoconductive drum most remote from the photoconductive drum 11K is positioned at its operative position at step S97. If only one photoconductive drum has the smallest count, at step S96, then the photoconductive drum is moved to its operative position at step S98.

After the photoconductive drums have been positioned at their corresponding positions (i.e., operative and non-operative positions), the print medium 19 (FIG. 31) is attracted to the transfer belt 16 and carried at step S99 to the transfer section for black. At the transfer section for black, a black toner image is transferred to the print medium 19 at step S100. At step S101, the print medium 19 is then separated from the transfer belt 16 and advanced to the fixing unit, not shown, where the toner image is fixed into a permanent print and then the print result is output at step S102.

If it is determined that a black printing is not to be performed (i.e., a color printing is to be performed), then all the photoconductive drums 11Y, 11M, 11C, and 11K are positioned at their operative positions at step S93, and then the program proceeds to step S99.

As mentioned above, when a black printing is performed, the "auxiliary attraction section" may be formed by positioning one or more of the photoconductive drums 11Y, 11M, and 11C at their operative positions. In this manner, the print medium 19 continues to be sufficiently attracted when it is traveling from the attraction section 21 to the "auxiliary attraction section" and from the "auxiliary attraction section" to the transfer section for black.

The aforementioned construction allows stable transportation of the print medium 19. The apparatus can operate at a lower attraction voltage, consuming less electric power as well as reducing the manufacturing cost of a power supply, not shown, for applying the attraction voltage $F_{ix}$.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An electrophotographic printer comprising:

a transfer belt driven to run with a print medium placed thereon;

a plurality of image bearing bodies disposed in a direction in which said transfer belt runs; and a plurality of transferring devices, each opposing one of said plurality of image bearing bodies to form a transfer section, each of said transferring devices selectively receiving a first voltage and a second voltage supplied thereto, the first voltage being of the same polarity as and higher than the second voltage, the first voltage being received when an image of a corresponding color is being transferred from a corresponding one of said image bearing bodies to the print medium, and the second voltage being received when the image of the corresponding color is not being transferred from the corresponding one of said image bearing bodies to the print medium.

2. An electrophotographic printer comprising:

a transfer belt driven to run with a print medium placed thereon;

a plurality of image bearing bodies disposed in a direction in which said transfer belt runs;

a transfer voltage outputting section selectively applying a first voltage and a second voltage to each of said plurality of transferring devices, the first voltage being higher than the second voltage;

an environmental condition detector that detects environmental conditions;

a transfer voltage setting section that sets the second voltage in accordance with the environmental conditions; and a plurality of transferring devices, each opposing one of said plurality of image bearing bodies to form a transfer section, each of said transferring devices selectively receiving the first voltage and the second voltage, the first voltage being received when an image of a corresponding color is being transferred from a corresponding one of said image bearing bodies to the print medium, and the second voltage being received when the image of the corresponding color is not being transferred from the corresponding one of said image bearing bodies to the print medium.

3. The electrophotographic printer according to claim 2, wherein the second voltage in a low-temperature and low-humidity environment is lower than in a high-temperature and high-humidity environment.

4. The electrophotographic printer according to claim 2, further comprising voltage-clamping means provided downstream of said transfer belt with respect to the direction in which the transfer belt runs, the voltage-clamping means clamping a voltage of the print medium at a predetermined value.

5. The electrophotographic printer according to claim 1, further comprising:

a print-medium sensor that detects a position of the print medium relative to the transfer section; and a transfer voltage correcting section that adjusts the first voltage applied to one of said plurality of transferring devices when a rearward end of the print medium leaves another one of said plurality of transferring devices.

6. The electrophotographic printer according to claim 5, further comprising an environmental condition detector that detects environmental conditions; and wherein said transfer voltage correcting section adjusts the first voltage and the second voltage in accordance with the environmental conditions.

7. The electrophotgraphic printer according to claim 5, wherein when the rearward end of the print medium has passed a transfer point, said transfer voltage correcting section adjusts the first voltage that is applied to a transfer device located immediately downstream of the transfer point with respect to the direction in which the transfer belt runs.

8. The electrophotgraphic printer according to claim 5, wherein said transfer voltage correcting section adjusts the first voltage in accordance with environmental conditions.

9. The electrophotgraphic printer according to claim 5, wherein said transfer voltage correcting section adjusts the first voltage applied to a transfer device located most downstream of the transfer point with respect to the direction in which the transfer belt runs.

10. The electrophotgraphic printer according to claim 9, wherein said transfer voltage correcting section adjusts the first voltage every time the rearward end of the print medium has passed a transfer point upstream of the print medium with respect to the direction in which the transfer belt runs.

11. The electrophotographic printer according to claim 1, further comprising:

a print state detector that detects a number of cumulative pages in continuous printing from when the continuous printing is started;

wherein said transfer voltage correcting section adjusts the first voltage and the second voltage in accordance with the number of cumulative pages.

12. The electrophotographic printer according to claim 11, wherein said transfer voltage correcting section further adjusts the first voltage and the second voltage in accordance with a length of time between a first continuous printing and a second continuous printing.

13. An electrophotographic printer, comprising:

a transfer belt driven to run with a print medium placed thereon;

a plurality of image-bearing bodies disposed in a direction in which said transfer belt runs;

a plurality of transferring devices, each opposing one of said plurality of image-bearing bodies with said transfer belt therebetween; and an image-bearing body positioning section that drives each of said plurality of image-bearing bodies to selectively move to an operative position and a non-operative position;

wherein when monochrome printing is performed to print an image of a color, one of said plurality of image bearing bodies corresponding to the color is moved to the operative position and at least one of said plurality of image-bearing bodies not corresponding to the color is moved to an operative position to transport the print medium.

14. The electrophotographic printer according to claim 13, wherein the transferring devices opposing the image-bearing bodies not corresponding to the color receive a voltage that attracts the print medium to transport the print medium.

15. An electrophotgraphic printer, comprising:

a transfer belt driven to run with a print medium placed thereon;

a plurality of image-bearing bodies disposed in a direction in which said transfer belt runs;

a plurality of transferring devices, each opposing one of said plurality of image-bearing bodies with said transfer belt therebetween;

an image-bearing body positioning section that drives each of said plurality of image-bearing bodies to selectively move to an operative position and a non-operative position; and a counter that detects a number of cumulative rotations of each of said plurality of image-bearing bodies;

wherein when monochrome printing is performed to print an image of a color, one of said plurality of image-bearing bodies corresponding to the color is moved to the operative position, and one of said plurality of image-bearing bodies not corresponding to the color is moved to the operative position in accordance with the number of cumulative rotations.

16. The electrophotographic printer according to claim 15, wherein the one of said plurality of image-bearing bodies not corresponding to the color has a least number of cumulative rotations.

17. The electrophotographic printer according to claim 15, wherein if more than one of said plurality of image-bearing bodies not corresponding to the color have a same least number of cumulative rotations, the image-bearing body most remote from the image-bearing body corresponding to the color is moved to the operative position.

* * * * *